US007293845B2

(12) United States Patent
Hoffman

(10) Patent No.: US 7,293,845 B2
(45) Date of Patent: Nov. 13, 2007

(54) INTERLOCK MECHANISM FOR LATERAL FILE CABINETS

(75) Inventor: Keith A. Hoffman, Hudsonville, MI (US)

(73) Assignee: Knape & Vogt Manufacturing Company, Grand Rapids, MI (US)

( * ) Notice: Subject to any disclaimer, the term of this patent is extended or adjusted under 35 U.S.C. 154(b) by 0 days.

(21) Appl. No.: 11/455,454

(22) Filed: Jun. 19, 2006

(65) Prior Publication Data

US 2007/0013274 A1 Jan. 18, 2007

Related U.S. Application Data

(62) Division of application No. 10/375,672, filed on Feb. 27, 2003, now Pat. No. 7,063,398.

(60) Provisional application No. 60/429,772, filed on Nov. 27, 2002.

(51) Int. Cl.
*E05C 7/06* (2006.01)

(52) U.S. Cl. ..... 312/219; 312/221

(58) Field of Classification Search ..... 312/215, 312/216, 217, 218, 219, 221, 222
See application file for complete search history.

(56) References Cited

U.S. PATENT DOCUMENTS

| | | | |
|---|---|---|---|
| 3,941,441 | A | 3/1976 | Scheerhorn |
| 4,239,309 | A | 12/1980 | De Fouw et al. |
| 4,240,685 | A | 12/1980 | Terlecki |
| 4,246,769 | A | 1/1981 | McLaughlin |
| 4,355,851 | A | 10/1982 | Slusser |
| 4,429,930 | A | 2/1984 | Blouin |
| 4,637,667 | A | 1/1987 | Reid et al. |
| 4,711,505 | A | 12/1987 | Lakso |
| 4,732,434 | A | 3/1988 | Hartrum |
| 4,737,039 | A | 4/1988 | Sekerich |
| 4,820,002 | A | 4/1989 | Lechner |
| 4,889,396 | A | 12/1989 | Mitchell et al. |
| 4,955,672 | A | 9/1990 | Pham |

(Continued)

FOREIGN PATENT DOCUMENTS

DE 4416768 * 11/1994

OTHER PUBLICATIONS 1-page Knape & Vogt Interlok brochure (double-sided) describing an interlock system dated 1997.

*Primary Examiner*—Janet M. Wilkens
(74) *Attorney, Agent, or Firm*—Hanley, Flight & Zimmerman, LLC

(57) ABSTRACT

Interlocks for file cabinets and the like which generally prevent more than one drawer from being opened at a given time. The interlocks include an elongated, flexible member, such as a cable, which is changeable from a high slack condition to a low slack condition. In the low slack condition, the interlocks prevent their associated drawers that are closed from being opened. In the high slack condition, the interlocks allow their associated drawer to be opened. The interlocks may be used in conjunction with a lock that selectively changes the cable from a high slack condition to a low slack condition and vice versa. The interlocks may be constructed to exert a force on the cable that is a small fraction of the pulling force exerted on a locked drawer.

41 Claims, 14 Drawing Sheets

U.S. PATENT DOCUMENTS 4,957,334 A 9/1990 Lakso
4,960,309 A 10/1990 Scheerhorn
4,966,423 A 10/1990 Higuera
5,050,942 A 9/1991 Frederick et al.
5,056,876 A 10/1991 Scheerhorn
5,056,877 A 10/1991 Westwinkel
5,062,678 A 11/1991 Westwinkel
5,176,436 A * 1/1993 Mitchell ..... 312/221
5,184,887 A 2/1993 O'Keefe et al.
5,199,774 A 4/1993 Hedinger et al.
5,225,825 A 7/1993 Warren
5,303,994 A 4/1994 Elsholz
5,333,949 A 8/1994 McGregor
5,335,986 A 8/1994 Hartrum et al.
5,352,030 A 10/1994 Derle et al.
5,389,919 A 2/1995 Warren et al.
5,427,445 A 6/1995 Mitchell
5,466,060 A 11/1995 Hoffman
5,472,272 A 12/1995 Hoffman
5,507,571 A 4/1996 Hoffman
5,533,798 A 7/1996 Feldpausch et al.
5,586,817 A 12/1996 Hubbard et al.
5,671,985 A 9/1997 Grieser et al.
5,685,622 A 11/1997 Laakso
5,695,265 A 12/1997 Hoffman
5,709,442 A 1/1998 Feldpausch et al.
5,805,074 A 9/1998 Warren et al.
5,823,643 A 10/1998 Feldpausch et al.
5,829,859 A 11/1998 Cram
5,865,404 A 2/1999 Hesley
5,868,479 A 2/1999 Hoffman
5,931,548 A 8/1999 Bischoff
5,988,778 A 11/1999 Lammens
5,997,114 A 12/1999 Bischoff
6,033,047 A 3/2000 Hoffman
6,082,839 A 7/2000 Chiku
6,186,606 B1 2/2001 Krei
6,238,024 B1 5/2001 Sawatzky
6,296,332 B1 10/2001 Lammens
6,779,855 B2 * 8/2004 Hoffman ..... 312/219
7,063,398 B2 * 6/2006 Hoffman ..... 312/219
2002/0014817 A1 2/2002 Lammens
2002/0093274 A1 7/2002 Jackson

* cited by examiner

INTERLOCK MECHANISM FOR LATERAL FILE CABINETS

This application is a division of U.S. patent application Ser. No. 10/375,672, now U.S. Pat. No. 7,063,398, filed on Feb. 27, 2003, which claims priority to commonly assigned U.S. Provisional Application Ser. No. 60/429,772 filed on Nov. 27, 2002, the disclosure of which is hereby incorporated herein in its entirety by reference.

BACKGROUND OF THE INVENTION

The present invention relates to filing cabinets, and more particularly to mechanisms adapted to prevent one or more of the drawers in the filing cabinet from being opened.

It has been known in the past to include interlock mechanisms on filing cabinets that prevent more than one drawer in the cabinet from being opened at a single time. These interlock mechanisms are generally provided as safety features that are intended to prevent the filing cabinet from accidentally falling over, a condition that may be more likely to occur when more than one drawer in the cabinet is open. By being able to open only a single drawer at a given time, the ability to change the weight distribution of the cabinet and its contents is reduced, thereby diminishing the likelihood that the cabinet will fall over.

In addition to such interlocks, past filing cabinets have also included locks that prevent any drawers from being opened when the lock is moved to a locking position. These locks are provided to address security issues, rather than safety issues. These locks override the interlocking system so that if the lock is activated, no drawers may be opened at all. If the lock is not activated, the interlock system functions to prevent more than one drawer from being opened at the same time. Oftentimes the system that locks all of the drawers and the interlock system that locks all but one of the drawers are at least partially combined. The combination of the locking system with the interlocking system can provide cost reductions by utilizing common parts.

Past locking and interlocking mechanisms, however, have suffered from a number of disadvantages. One disadvantage is the difficulty of changing the drawer configurations within a cabinet. Many filing cabinets are designed to allow different numbers of drawers to be housed within the cabinet. For example, in the cabinet depicted in FIG. 1, there are three drawers in the cabinet. For some cabinets, it would be possible to replace these three drawers with another number of drawers having the same total height as the three original drawers. This reconfiguration of the drawers is accomplished by removing the drawer slides on each side of the drawer and either repositioning the drawer slides at the newly desired heights, or installing new drawer slides at the new heights. Many drawer slides include bayonet features that allow the drawer slides to be easily removed and repositioned within the cabinet.

In the past, such reconfiguring of the drawers in a cabinet has been a difficult task because the interlocking and/or locking system for the drawers could not easily be adjusted to match the newly configured filing cabinet. For example, U.S. Pat. No. 6,238,024 issued to Sawatzky discloses an interlock system that utilizes a series of rigid rods that are vertically positioned between each drawer in the cabinet. The height of these rods must be chosen to match the vertical spacing between each of the drawers in the system. If the cabinet is to be reconfigured, then new rods will have to be installed that match the height of the new drawers being installed in the cabinet. Not only does this add additional cost to the process of reconfiguring the cabinet, it complicates the reconfiguring process by requiring new parts of precise dimensions to be ordered. Finding these precisely dimensioned parts may involve extensive searching and/or measuring, especially where the manufacturer of the rods is not the same entity that produced the new drawers being installed, or the manufacturer of the rods has ceased producing the parts, or has gone out of business.

Another difficulty with systems like that disclosed in the Sawatzky patent is the precise manufacturing that may be required to create these rigid rods. These interlock systems only work if the rods have heights that fall within a certain tolerance range. This tolerance range, however, decreases as more interlocks are installed in a given cabinet. In other words, the tolerance of the heights of these rods is additive. In order to function properly, a cabinet with ten drawers will therefore require smaller tolerances in the rods than a two drawer cabinet. In order to create rods that can be universally used on different cabinets, it is therefore necessary to manufacture the rods within the tight tolerances required by the cabinet having the greatest expected number of drawers. These tight tolerances tend to increase the cost of the manufacturing process.

Another difficulty with past interlock and lock systems for file cabinets has been the expense involved in creating a locking system that will withstand high forces exerted on the drawers. The Business and Institutional Furniture Manufacturer's Association (BIFMA) recommends that lock systems for file cabinets be able to withstand 50 pounds of pressure on a drawer. Thus, if a file cabinet does not exceed this standard, thieves can gain access to the contents of a lock drawer by pulling the drawer outwardly with more than fifty pounds of force. Many users of file cabinets, however, desire their locking system to be able to withstand much greater forces than this before failure. Increasing the durability of the locking system often adds undesired expense to the cost of building the system.

A number of prior art interlock systems have used cables or straps as part of the interlocking system. Such systems, however, have suffered from other disadvantages. For example, U.S. Pat. No. 5,199,774 issued to Hedinger et al. discloses an interlock and lock system that uses a cable. The slack in the cable is decreased when a drawer is opened. The amount of slack of the cable is carefully chosen during the installation of the drawer lock so that there is just enough in the system to allow only one drawer to be opened at a time. The interlock on whatever drawer is opened takes up this available slack in the cable, which prevents other drawers from being opened at the same time. A similar system is disclosed in U.S. Pat. No. 5,062,678 issued to Westwinkel. This system uses a strap instead of a cable. Both systems suffer from the fact that excessive amounts of force may be easily transferred to either the cable or the strap. In other words, the cable or the strap itself are what resist the pulling force that a person might exert on a closed drawer when either the lock is activated, or another drawer is opened. The tensile strength of the cable or strap therefore determines how much force must be exerted to overcome the interlock or lock. In fact, in the interlock of Westwinkel, the system appears to be constructed so that the pulling force exerted by a person on a locked drawer will be amplified before being applied to the strap. The strap must therefore have a greater tensile strength than the highest rated pulling force that the lock or interlock system can resist. Increasing the strength of the cables or straps typically tends to increase their cost, which is desirably avoided.

In light of the foregoing, the desirability of an interlock and lock system that overcomes these and other disadvantages can be seen.

SUMMARY OF THE INVENTION

Accordingly, the present invention provides an interlock and lock that reduces the aforementioned difficulties, as well as other difficulties. The interlock and lock of the present invention allow relatively low-tensile strength cables or flexible members to be used in systems which provide high resistance to theft and breakdown. The system of the present invention further allows changes to cabinet configurations to be easily implemented with little or no additional work required to integrate the new cabinet configuration into the interlock or lock system. The present invention provides a simple construction for locks and interlocks that can be easily manufactured without excessively restrictive tolerances, and which can be easily installed in cabinets.

According to one aspect of the present invention, an interlock for a cabinet drawer is provided. The drawer is movable in the cabinet is a first direction toward an open position and in a second, opposite direction toward a closed position. The interlock includes an elongated, flexible member, a rotatable lever, an engagement member, and a biasing member. The lever is adapted to alter the amount of slack in the elongated, flexible member. The lever is rotatable between a first position and a second position. The first position creates a low amount of slack in the elongated, flexible member, and the second position allows a high amount of slack to be present in the elongated, flexible member. The engagement member is attached to the drawer and positioned to cause the rotatable lever to rotate toward the first position when the drawer is initially moved from the closed position in the first direction. The biasing member is positioned adjacent the lever and adapted exert a biasing force that tends to prevent the lever from rotating from the first position to the second position until the drawer is moved in the second direction to the closed position.

According to another aspect of the present invention, an interlock is provided. The interlock includes a cable, a rotatable lever, an engagement member, and a retainer. The lever is adapted to change the cable between high and low slack conditions. The engagement member is attached to the drawer and positioned to cause the lever to rotate to a first position that changes the cable to a low slack condition when the drawer is initially moved in the first direction from the closed position. The engagement member is also positioned such that a first force exerted on the drawer in the first direction is translated by the lever to a second force on the cable, which is less than the first force. The retainer is adapted to retain the rotatable lever in the first position while the drawer is moved to the open position.

According to still another aspect of the present invention, a locking and interlocking system for a cabinet is provided. The system includes a lock, a first cable, a second cable, a first interlock, and a second interlock. The first cable extends between at least a first and second drawer. The first cable is changeable from a high slack to a low slack condition. The second cable extends between the lock and the first drawer. The lock is adapted to change the second cable from a high slack to a low slack condition. The first interlock is in communication with the first and second cables and adapted to change both said first and said second cables from the high slack to the low slack condition whenever the first drawer is opened. The first interlock is further adapted to prevent the first drawer from opening whenever the first or second cables are in the low slack condition. The second interlock is in communication with the first cable and adapted to change the first cable from the high slack to the low slack condition whenever the second drawer is opened. The second interlock is further adapted to prevent the second drawer from opening whenever the first cable is in the low slack condition.

According to yet another aspect of the present invention, a cabinet is provided that includes at least one drawer movable within the cabinet in a first direction toward an open position and in a second, opposite direction toward a closed position. The cabinet further includes a frame adapted to support the drawer, an elongated, flexible member, an interlock, and a slack take up mechanism. The elongated, flexible member is positioned within the cabinet and changeable between a lower slack condition and a higher slack condition. The interlock is positioned within the frame and in operative engagement with the elongated, flexible member. The interlock is adapted to prevent the drawer from moving to the open position when the elongated, flexible member is in the lower slack condition and to allow the drawer to move to the open position when the elongated, flexible member is in the higher slack condition. The slack take up mechanism is adapted to change the elongated, flexible member from the higher slack condition to the lower slack condition when the drawer is moved from the closed position to the open position. The slack take up mechanism is further adapted to translate a first force exerted on the drawer in the first direction to a second force exerted on the elongated, flexible member which is less than the first force.

According to still other aspects of the present invention, the interlock may be in communication with a lock that is adapted to selectively alter the condition of the cable. The interlocks may be secured to drawer slides that are removable from the cabinet. A cable guide may be included as part of the interlock to snap-fittingly receive the cable and retain it in engagement with the interlock.

The various aspect of the present invention provides an interlock and lock system that is versatile, resistant to high forces, and easily installed. These and other benefits of the present invention will be apparent to one skilled in the art in light of the following written description when read in conjunction with the accompanying drawings.

DETAILED DESCRIPTION OF THE INVENTION

Figure 1:
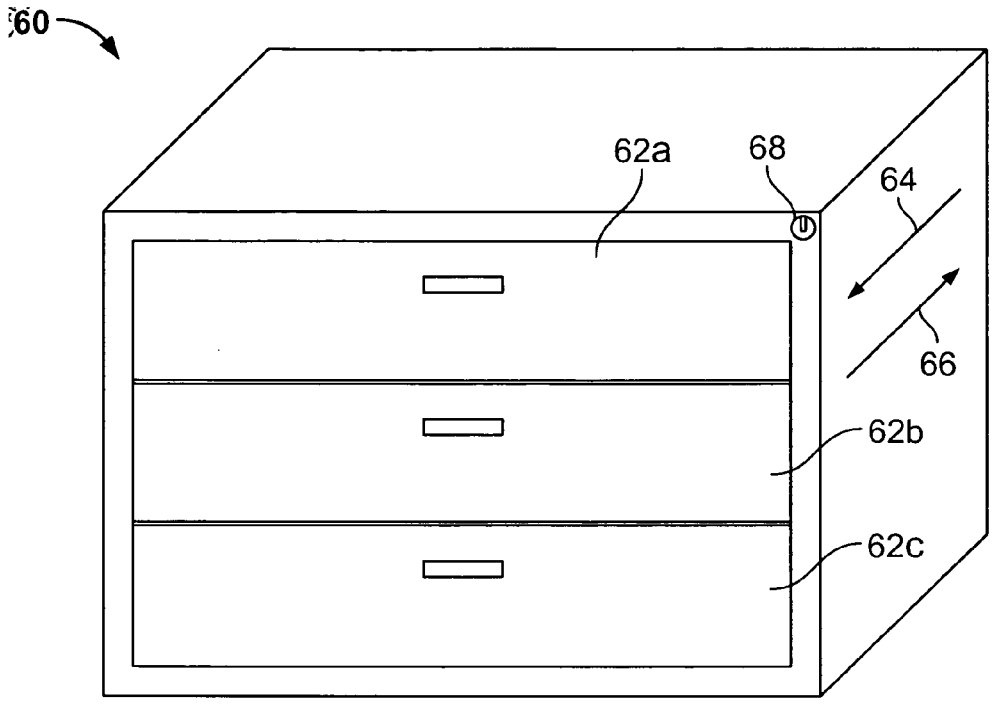
FIG. 1 is a perspective view of a cabinet with three drawers in a closed position.
Figure 2:
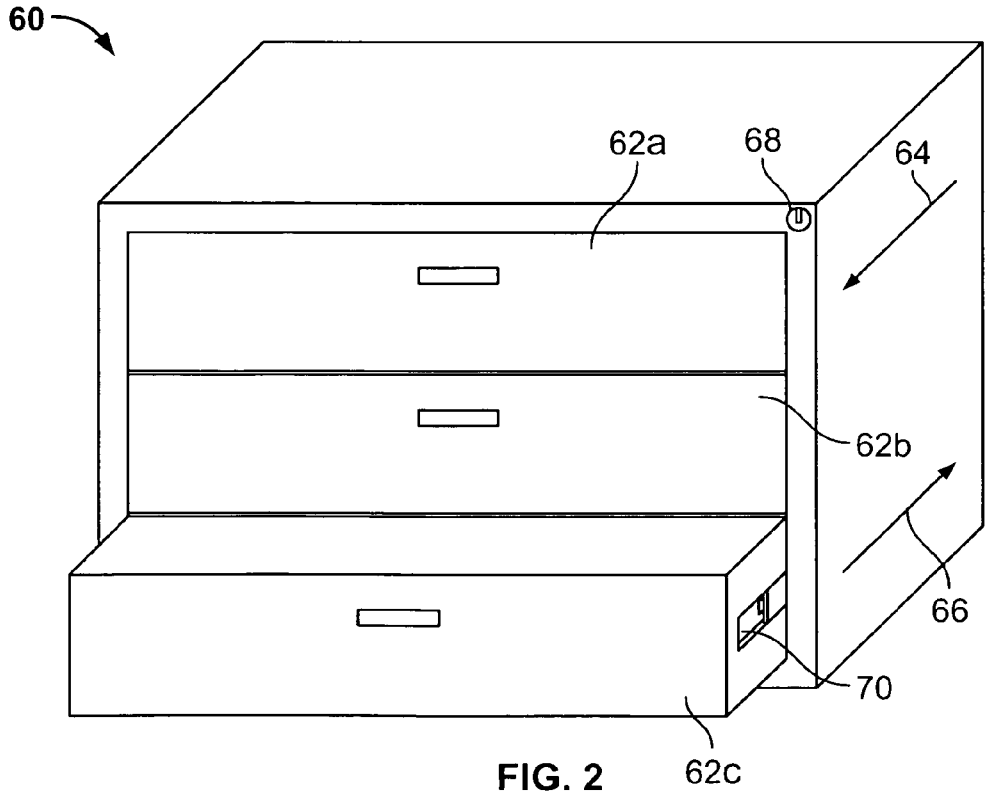
FIG. 2 is a perspective view of the cabinet of FIG. 1 illustrated with one drawer moved to an open position.

The present invention will now be described with reference to the accompanying drawings wherein the reference numerals in the following written description correspond to like numbered elements in the several drawings. The present invention relates to locks and interlocks that may be used with file cabinets, such as the file cabinet 60 depicted in FIGS. 1 and 2. File cabinet 60 includes three drawers 62*a-c* that are essentially stacked on top of each other in file cabinet 60. Each drawer can be pulled in a first direction 64 toward an open position. The lower most drawer 62*c* in FIG. 2 is illustrated in the open position. When it is time to close this drawer, it can be pushed in a second direction 66 back to its closed position. The interlocking system of the present invention prevents more than one drawer from being opened at a single time. While only three drawers are illustrated in file cabinet 60, the present invention is applicable to cabinets having any number of drawers. The present invention also includes a locking system that overrides the interlocking system. That is, when the locking system is activated, no drawers can be opened at any time. When the locking system is deactivated, the interlocking system is activated and prevents more than one drawer from being opened at a single time. The locking system may be activated by inserting a key into a keyhole 68 positioned at any suitable location on the file cabinet. The locking and interlocking system are highly integrated so that many of the components of the interlocking system are also used in the locking system.

The interlocks of the present invention may be advantageously combined or attached to the drawer slides in which drawers 62 slidingly move between their open and closed position. An example of one of these drawer slides 70 is depicted in FIG. 2 for the lower most drawer 62*c*. Each drawer 62 includes two drawer slides 70, one positioned on one side of the drawer and another positioned on the opposite side of the drawer. While the interlocks of the present invention can be placed at other locations besides on drawer slide 70, the attachment of the interlocks to the drawer slide 70 allows the interlocks to be simultaneously removed and repositioned when the drawer slides 70 are removed and repositioned. This greatly facilitates the reconfiguration of a file cabinet 60 with differently sized drawers 62.

Figure 3:
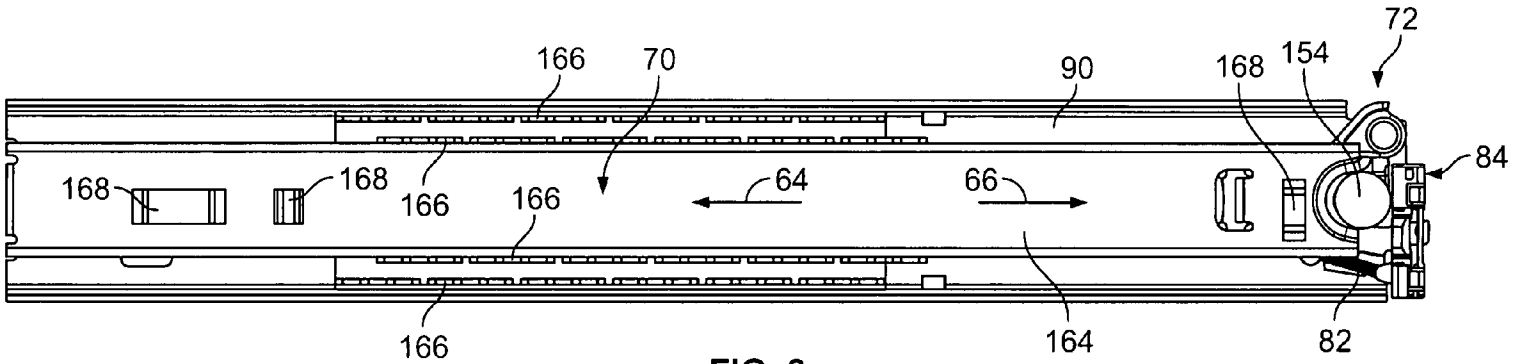
FIG. 3 is a side, elevational view of a drawer slide and interlock according to one embodiment of the present invention.

An interlock 72 according to a first embodiment of the present invention is depicted in FIG. 3. Interlock 72 is attached to a drawer slide 70. Interlock 72 is operatively coupled to a cable 74 (FIG. 6) that runs vertically inside of cabinet 60. In general, interlock 72 operates according to the amount of slack in cable 74. Specifically, cable 74 has two different basic levels of slack. When no drawers are opened and the lock is not activated, cable 74 has a high amount of slack in it. When a single drawer is opened, interlock 72 takes up most or all of the slack in cable 74 and creates a second, lower level of slack in cable 74. The lower level of slack in cable 74 is such that no other drawers in the cabinet 60 can be opened. This lower level of slack may be zero, or may include a small amount of slack. When the open drawer is closed, more slack in the cable 74 returns and any other single drawer may thereafter be opened. If a lock is included with the cabinet 60, the lock is adapted to alter the slack in cable 74. When in the locked position, the lock removes most or all of the slack in cable 74. When in the unlocked condition, the lock allows cable 74 to have sufficient slack so that a single drawer may be opened. Interlocks 72 are thus designed to only allow their associated or attached drawer to be opened when cable 74 has sufficient slack. Further, they are designed to remove substantially all of the slack in cable 74, if their associated drawer is opened. The detailed construction of interlock 72, as well as how they accomplish the aforementioned functions, will now be described.

Interlock 72 is adapted to be attached directly to a drawer slide 70. While interlock 72 is depicted attached to the back ends of drawer slides 70, it will be appreciated that it can be attached to the drawer slides at any desirable location along the drawer slides' length, or they can be attached directly to the cabinet. Interlock 72 operates in conjunction with cable 74 so that only a single drawer can be open at a given time. If a lock is included in the cabinet, the lock is in communication with cable 74 and can change the amount of slack in cable 74. If the lock is activated, cable 74 has little or no slack, and none of the drawers may be opened. Interlock 72 allows a small portion of the pulling force exerted on a drawer in first direction 64 to be transmitted to cable 74. Nevertheless, the amount of force transmitted is so small that a cable 74 having a relatively low tensile strength can still be used in a cabinet which provides strong resistance to its locking system being overcome.

Figure 4:
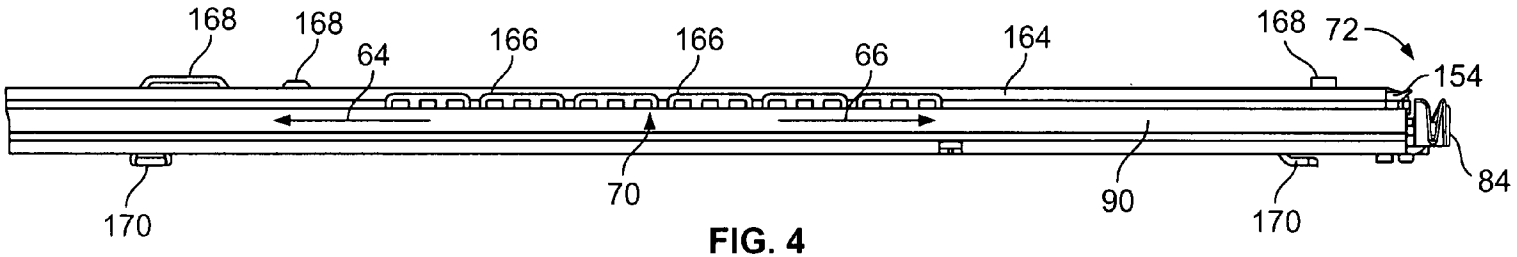
FIG. 4 is a bottom view of the drawer slide and interlock of FIG. 3.
Figure 5:
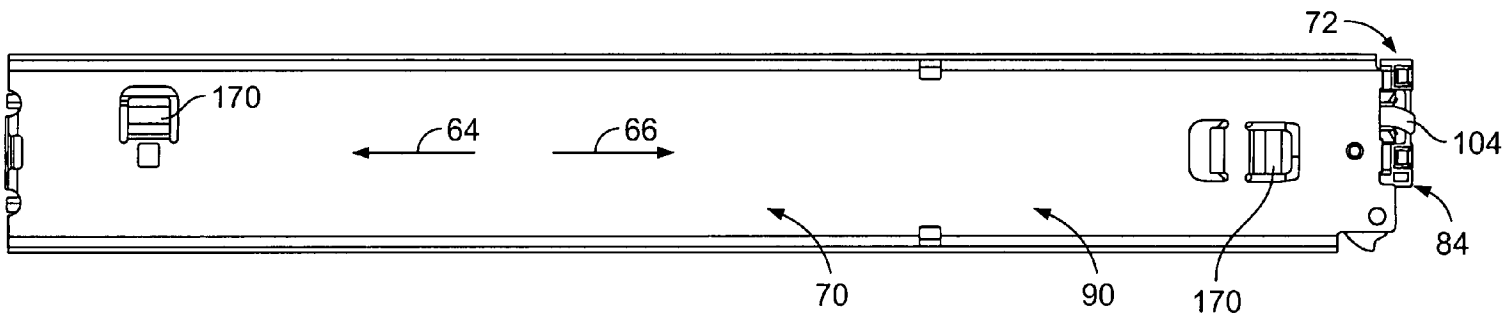
FIG. 5 is a side, elevational view of the drawer slide and interlock of FIG. 3 taken from a side opposite to that of FIG. 3.
Figure 7:
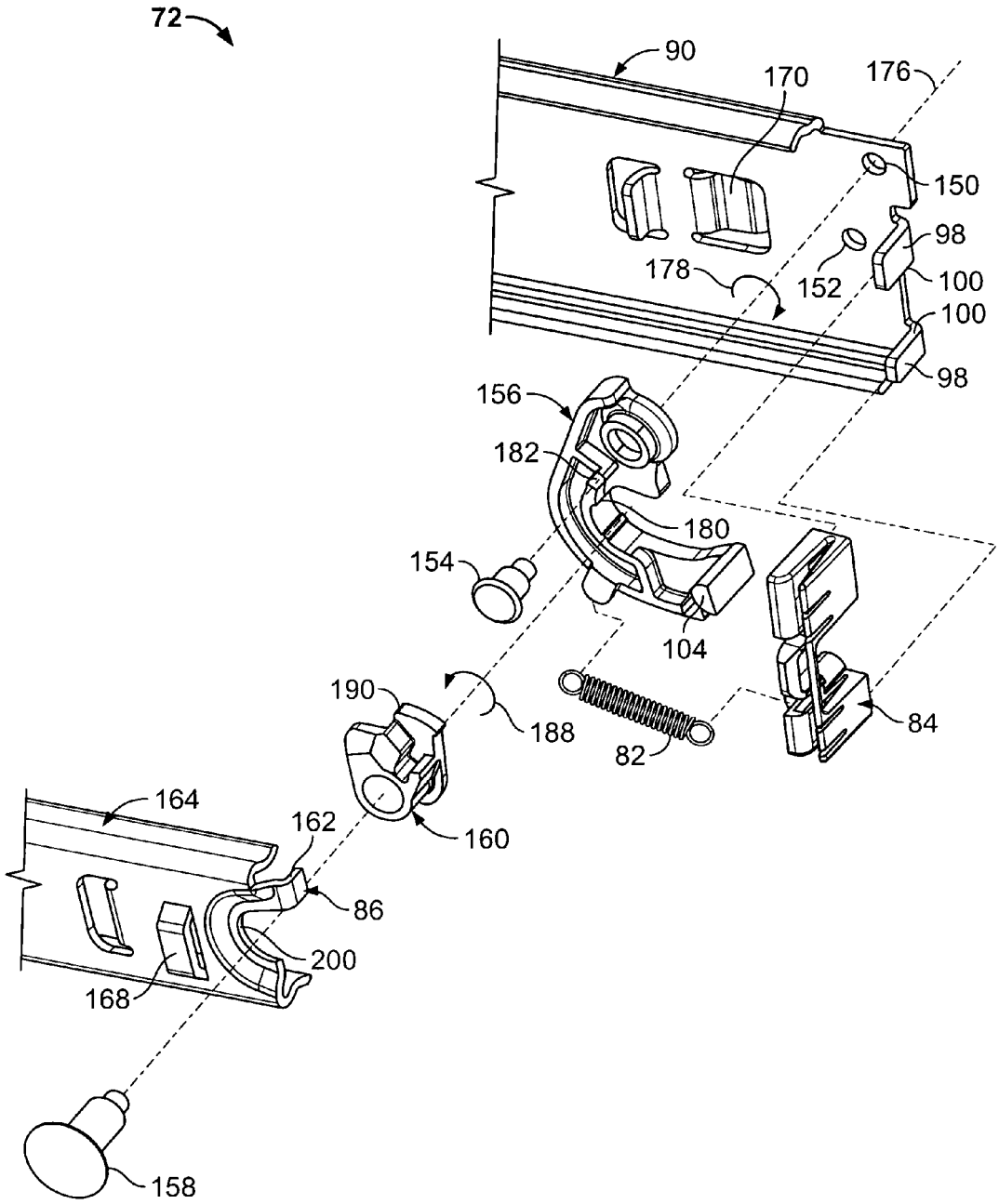
FIG. 7 is a perspective, exploded view of the components of the interlock of FIG. 3.
Figure 8:
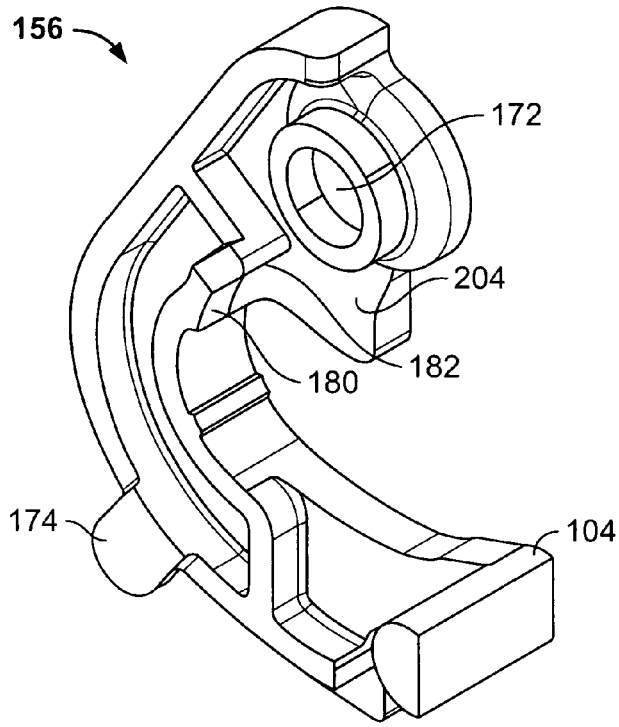
FIG. 8 is a perspective view of a lever of the interlock of FIG. 3.
Figure 9:
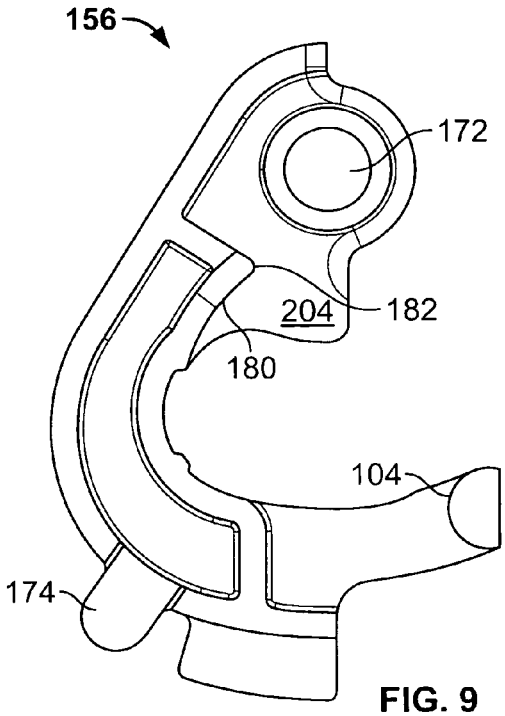
FIG. 9 is a plan view of the lever of FIG. 8.
Figure 10:
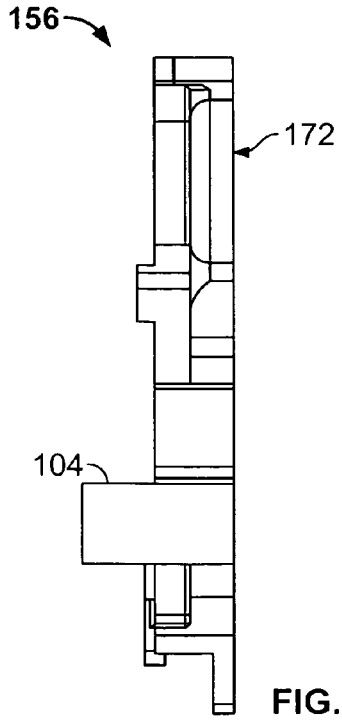
FIG. 10 is a side, elevational view of the lever of FIG. 8.
Figure 11:
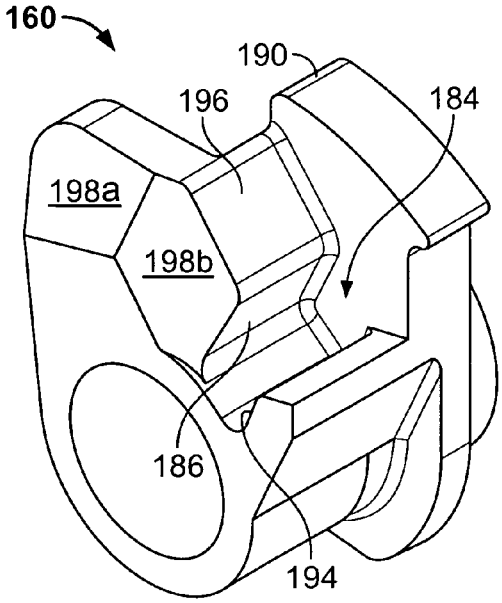
FIG. 11 is a perspective view of a cam of the interlock of FIG. 3.
Figure 12:
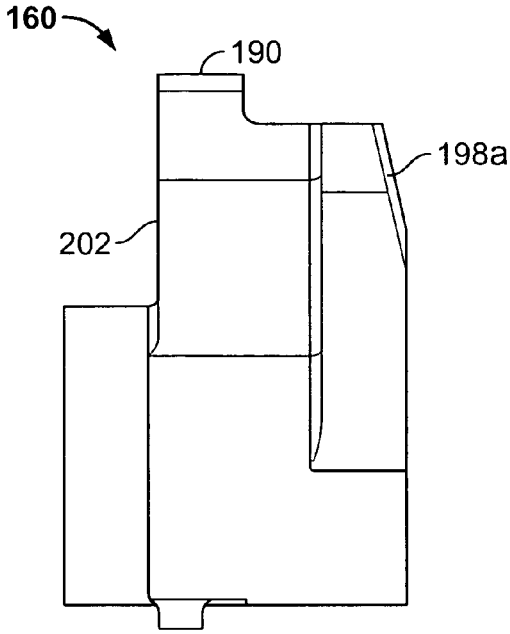
FIG. 12 is a side, elevational view of the cam of FIG. 11.
Figure 13:
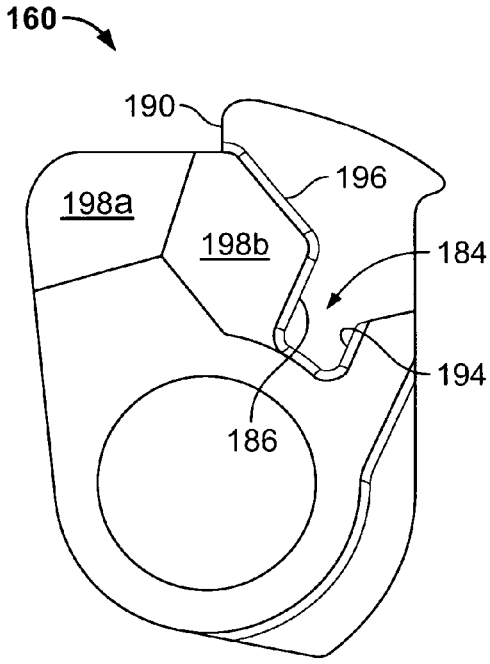
FIG. 13 is a plan view of the cam of FIG. 11.
Figure 14:
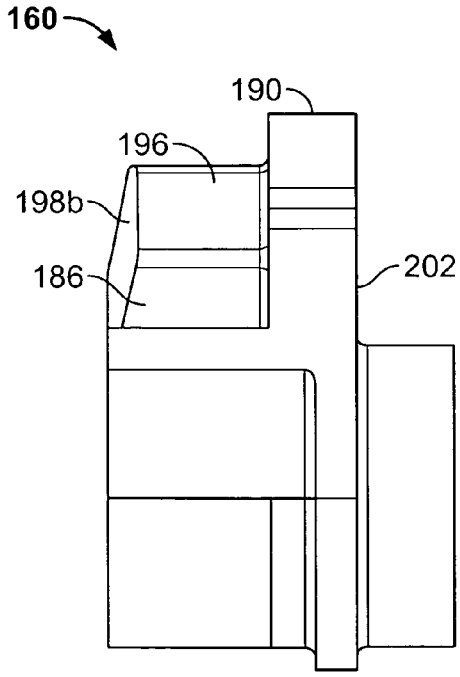
FIG. 14 is a side, elevational view of the cam of FIG. 11 taken from a side different from that of FIG. 12.

As can be easily seen in FIG. 7, interlock 72 is attached to stationary portion 90 of drawer slide 70. Stationary portion 90 is fixedly secured to the interior of cabinet 60. Stationary portion 90 includes an upper aperture 150 and a lower aperture 152. Upper aperture 150 receives a first rivet 154 that pivotally secures a lever 156 to stationary portion 90. Lower aperture 152 receives a second rivet 158 that pivotally secures a cam 160 to stationary portion 90. Interlock 72 further includes a cable guide 84 that is mounted to a pair of flanges 98 on stationary portion 90 in generally the same manner that cable guide 84 is mounted to attachment plate 76 of interlock 72. Interlock 72 further includes a spring 82 and an engagement member 86. Engagement member 86 comprises a flange 162 that extends off of a slidable portion 164 of drawer slide 70. Slidable portion 164 is slidable with respect to stationary portion 90 by way of a plurality of ball bearing cages 166 that house a plurality of ball bearings in contact with both slidable portion 164 and stationary portion 90 of drawer slide 70 (FIGS. 3-4). Slidable portion 164 is adapted to be secured to a drawer. Slidable portion 164 may include a plurality of attachment flanges 168 used to releasably secure slidable portion 164 to the drawer. Similarly, stationary portion 90 may also include a plurality of attachment flanges 170 used to releasably secure stationary portion 90 to the interior of the cabinet.

Lever 156, which is illustrated in more detail in FIGS. 7-10, is pivotable about a pivot axis generally defined by first rivet 154. Lever 156 includes an aperture 172 for receiving first rivet 154. Lever 156 includes a spring attachment nub 174 over which one end of spring 82 is secured. Lever 156 further includes an engagement lug 104 that engages cable 74. When lever 156 rotates about its pivot axis 176 in a direction 178 (FIG. 7), engagement lug 104 pulls against cable 74 decreasing the slack in cable 74. Spring 82 exerts a force on lever 156 that tends to resist rotation in direction 178.

Lever 156 includes an inner surface portion 180 and a crest 182. When a drawer is initially opened, cam 160 abuts against crest 182 and exerts a rotational force on lever 156. If cable 74 is not in a low slack condition, cam 160 pushes against crest 182 until lever 156 is rotated sufficiently to put cam 160 in contact with inner surface portion 180. This will be described in more detail below.

Cam 160, which is depicted in detail in FIGS. 7 and 11-14 is rotationally secured to stationary portion 90 of drawer slide 70 by way of second rivet 158. Cam 160 includes a recess 184 into which engagement member 86 fits when the associated drawer is in the closed position. Recess 184 includes a contact surface 186 which contacts engagement member 86 when the associated drawer is pulled in the first direction 64. When a drawer is pulled in first direction 64, engagement member 86 engages contact surface 186 and imparts a rotational force on cam 160. This rotational force is generally in the direction 188 (FIG. 7). Rotational direction 188 is the opposite of rotational direction 178. The rotation of cam 160 in direction 188 causes an edge 190 of cam 160 to press against crest 182 of lever 156. If sufficient rotational force is exerted on cam 160, edge 190 will push against lever 156 sufficiently to allow edge 190 to pass by the crest 182 on lever 156. Crest 182 may have an arced or radial surface that allows edge 190 to overcome it without an excessive force spike.

The rotation of cam 160 in direction 188 causes lever 156 to rotate in direction 178 (FIG. 7). The rotation of lever 156 takes up any slack in cable 74 by way of engagement member 86. If cable 74 is already in a low slack condition, lever 156 will be prevented from rotating sufficiently far enough to allow edge 190 of cam 160 to reach inner surface portion 180 of lever 156. The full rotation of cam 160 will therefore be prevented. Engagement member 86 of slidable portion 164 of drawer slide 70 will therefore not be able to disengage from recess 184 in cam 160. Drawer slide 70 will therefore not be able to slide, and the attached drawer will not be able to open.

Figure 6:
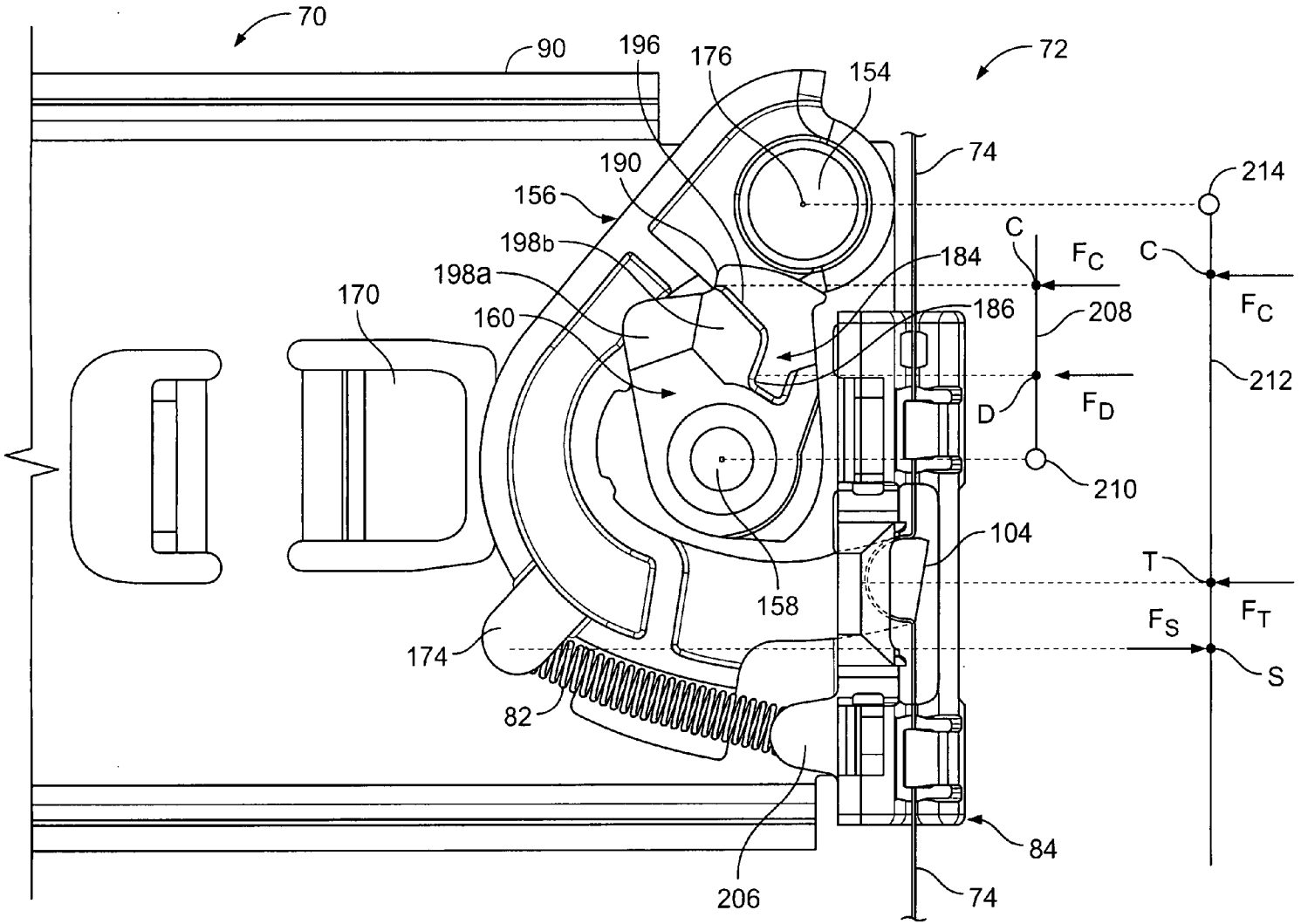
FIG. 6 is a front, elevational view of the interlock of FIG. 3.

When cable 74 is changed to the low slack condition by another interlock or lock, cam 160 cannot rotate further than the position depicted in FIG. 6. If cable 74 is not already in a low slack condition, then cam 160 will be able to rotate sufficiently far so that edge 190 contacts inner surface portion 180. When edge 190 is in contact with inner surface 180, cam 160 has rotated sufficiently far to allow engagement member 86 to disengage out of recess 184. Slide 70 is therefore free to slide and the attached drawer can be fully opened. When the drawer is fully open, spring 82 exerts a force on lever 156 in a direction opposite to rotational direction 178. This rotational force tends to maintain edge 190 in frictional contact with inner surface portion 180. This prevents edge 190 from sliding back to contact with crest 182 before the drawer is fully closed, and this maintains cam 160 in the proper rotational attitude for recess 184 to accept engagement member 86. When the drawer is being closed, engagement member 86 eventually comes into contact with a contact surface 194 defined on cam 160. As the drawer is fully closed, engagement member 86 pushes against contact surface 194 to thereby cause cam 160 to rotate in a rotational direction that is opposite to direction 188. This rotation causes edge 190 to move out of contact with surface portion 180 and into contact with crest 182. This, in turn, allows lever 156 to rotate in a direction opposite to direction 178. This rotation causes engagement lug 104 to decrease the force on cable 74. The closing of the drawer therefore decreases any tension in cable 74 and increases its slack.

In addition to maintaining cam 160 in its proper rotational orientation when a drawer is opened, spring 82 helps prevent the drawers from rebounding open, or partially open, after they are slammed shut. Without spring 82, it might be possible for a drawer to be slammed shut with sufficient force such that the rebound of the drawer in first direction 64 might rotate cam 160 and allow the drawer to open up again. Spring 82 helps prevent such rebounding of the drawers into the open position by biasing lever 156 in a direction that resists the rotation of cam 160. The amount of biasing is sufficient to generally overcome the amount of force typically present in a drawer rebound. The drawers therefore do not rebound open, but rather only open when a user applies sufficient force to overcome the biasing resistance that spring 82 exerts.

Cam 160 includes a sloped surface 196 that helps ensure that engagement member 86 is successfully guided back into recess 184 when a drawer is closed. If engagement member 86 contacts sloped surface 196, it will exert a rotational force on cam 160 that tends to rotate cam 160 so that recess 184 is properly aligned for receiving engagement member 86. Cam 160 further includes chamfered surfaces 198*a* and *b*. Chamfered surfaces 198 are designed to urge slidable portion 164 of drawer slide 70 into proper axial alignment with cam 160. Stated alternatively, if slidably portion 164 of drawer slide 70 is compressed toward stationary portion 90, chamfered surface 198 will contact an end flange 200 on slidable portion 164 and urge it away from stationary portion 90 (FIG. 7). Second chamfered surface 198*b* will continue to urge slidable portion 164 away from stationary portion 90 as the drawer is completely closed. Chamfered surfaces 198*a* and *b* therefore serve to help maintain the proper spacing of stationary portion 90 with respect to slidable portion 164.

Cam 160 further includes a slide surface 202 that overlays a respective slide surface 204 on lever 156 (FIGS. 8-14). Slide surfaces 202 and 204 help ensure that cam 160 and lever 156 maintain the proper axial position with respect to each other as they are rotated. Edge 190 of cam 160 may preferably be arced with a radius of 0.04 inches. Crest 182 may also be arced with a radius of 0.06 inches. Other values may, of course, be used. Rounding edge 190 and crest 182 reduces the amount of force necessary to open the drawer. However, rounding these surfaces excessively will cause more of the force exerted on a locked drawer to be transferred to the cable 74.

Figure 15:
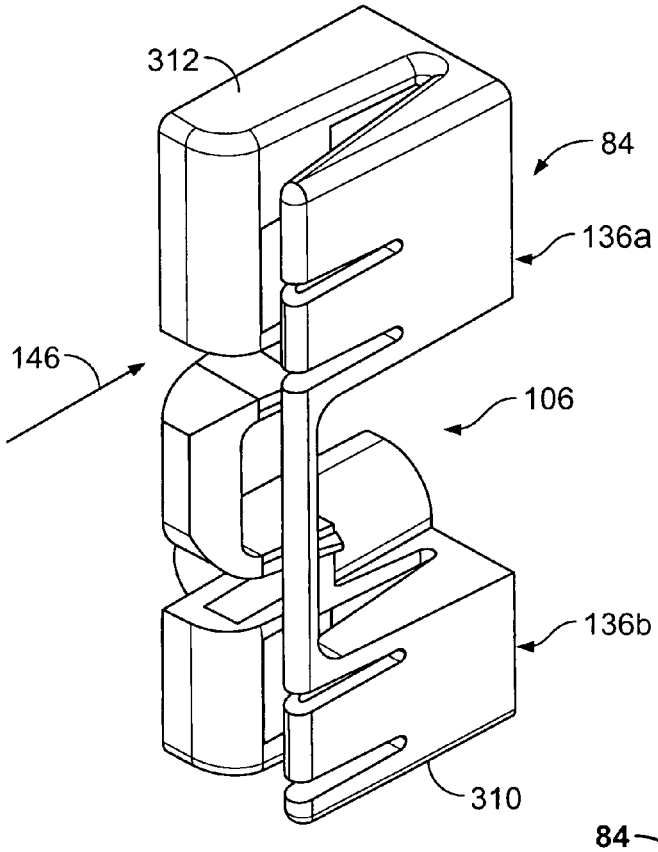
FIG. 15 is a perspective view of a cable guide of the interlock of FIG. 3.
Figure 16:
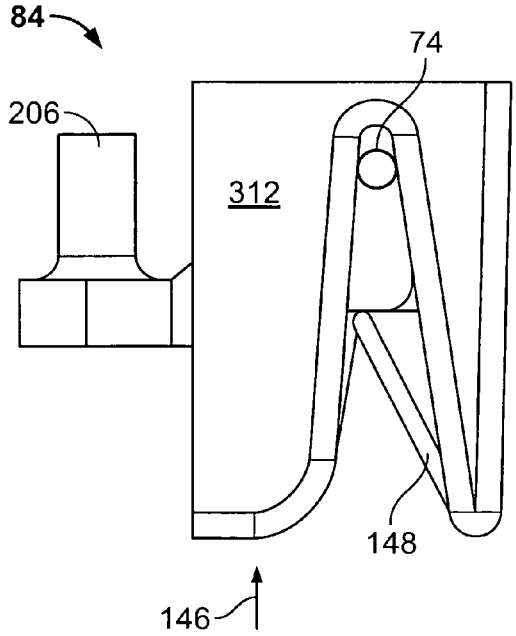
FIG. 16 is a top view of the cable guide of FIG. 15.
Figure 17:
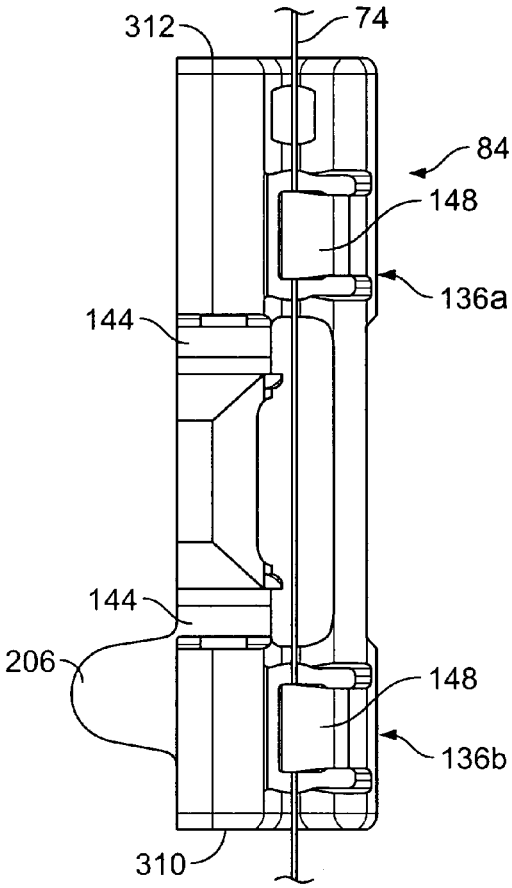
FIG. 17 is a plan view of the cable guide of FIG. 15.

Cable guide 84, which is depicted in more detail in FIGS. 15-17 serves to ensure that cable 74 is properly maintained in contact with engagement lug 104 of lever 156. Cable guide 74 may be manufactured of molded plastic. Cable guide 84 preferably snap-fittingly receives cable 84 so that cable 74 may be easily threaded into guide 84 with little danger of cable 74 becoming unthreaded. Cable guide 84 includes an upper and lower portion 136*a* and *b*. A channel 106 is defined between upper and lower portions 136*a* and *b*.

Cable 74 is easily threaded into cable guide 84 by moving cable 74 in direction 146 into channel 106 (FIG. 15). Movement of cable 74 in this direction causes the cable 74 to come in contact with two flexible arms 148. As cable 74 is further pushed against flexible arms 148, flexible arms 148 begin to flex out of the way until sufficient clearance is provided for cable 74 to pass by flexible arms 148. As soon as cable 74 passes by arms 148, they snap back to their unflexed condition. In this unflexed condition, cable 74 is prevented from being retracted out of cable guide 74 in a direction opposite the direction 146 by flexible arms 148. If an interlock 72 is to be removed from the inside of a cabinet, cable 74 can be easily removed from cable guide 84 by manually pressing flexible arms 148 in direction 146. Flexible arms 148 are pressed until sufficient clearance is provided for cable 74 to be retracted out of guide 84 in a direction generally opposite to direction 146.

Cable guide 84 includes a spring attachment nub 206 that holds an end of spring 82 opposite spring attachment nub 174 on lever 156. Cable guide 84 includes recesses (not shown) that receive flanges 98 and that interact with the shoulders 100 to secure guide 84 to stationary portion 90. These recesses are defined on the bottom of cable guide 84 and do not extend all the way through cable guide 84. Shoulders 100 abut against surfaces 144 when cable guide 84 is attached to stationary member 90 (FIG. 17).

Figure 18:
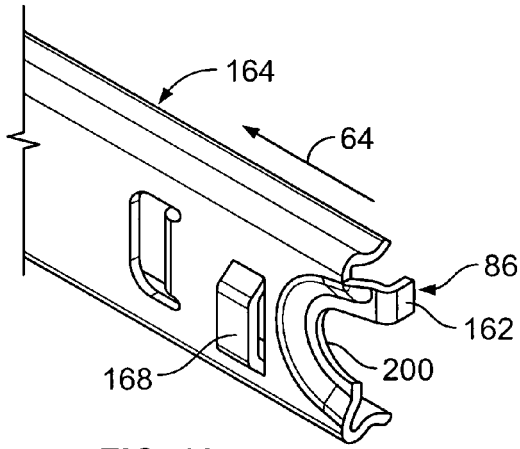
FIG. 18 is a partial, perspective view of a drawer slide member with an engagement member for engaging the interlock of FIG. 3.
Figure 19:
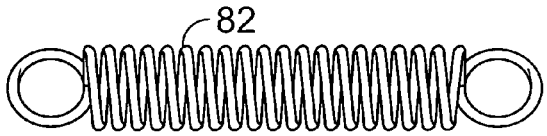
FIG. 19 is a side, elevational view of the spring of the interlock of FIG. 3.
Figure 20:
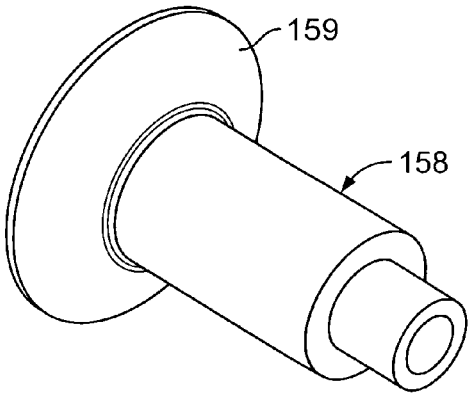
FIG. 20 is a perspective view of a rivet of the interlock of FIG. 3.
Figure 21:
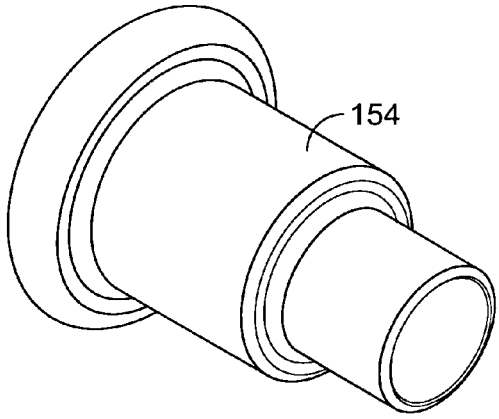
FIG. 21 is a perspective view of another rivet of the interlock of FIG. 3.

FIG. 18 depicts slidable portion 164 of drawer slide 70 in more detail. FIG. 19 depicts spring 82 in more detail. FIGS. 20 and 21 depict first and second rivets 154 and 158 respectively. Second rivet 158 includes a sloped undersurface 159 (FIG. 20) that helps to maintain slideable portion 164 of the drawer slide, as well as the attached drawer, in proper alignment with the stationary portion 90. If the drawer is subjected to pulling forces, or other types of forces, that tend to cause the drawer to rack or twist (especially if made out of thin sheet metal), these forces may move the back end of slideable portion 164 away from stationary portion 90. In such instances, end flange 200 will come into contact with sloped undersurface 159 of rivet 158 as the drawer is closed. The sloped nature of surface 159 will create a force on end flange 200 of slideable portion 164 that pushes the back end of slideable portion 164 toward stationary portion 90 in a direction generally parallel to pivot axis 176. This helps maintain the proper alignment of the drawer when it is closed. End flange 200 may be chamfered to correspond to the angle of undersurface 159 in order to more easily force the drawer into the proper alignment. Undersurface 159 also helps to ensure that engagement member 86 stays aligned with cam 160 so that engagement member 86 properly engages cam 160. Without rivet 158 and undersurface 159, it might be possible for a drawer to become excessively racked such that engagement member 86 no longer contacted cam 160 when the drawer was opened and closed. Undersurface 159 prevents this possibility.

The head of rivet 158 preferably does not extend farther away from the stationary portion 90 than does slideable portion 164. Rivet 158 therefore does not obstruct the drawer attached to slideable portion 164 and the back end of the drawer may extend all the way back to the back end of the drawer slide. Interlock 72 therefore does not put any space limitations on the dimensions of the drawer other than those required by the drawer slide.

As mentioned previously, interlock 72 is designed to transfer only a small fraction of a pulling force exerted on a drawer onto cable 74. This reduction in forces can best be understood with reference to FIG. 6. FIG. 6 illustrates interlock 70 in the position it would be in when the attached drawer is being pulled in the open direction while cable 74 is in a taut or low slack condition. The tautness of cable 74 prevents interlock 70 from allowing the drawer to be opened. FIG. 6 depicts interlock 72 with slidable portion 164 and second rivet 158 removed in order to illustrate the underlying structure. Line 208 represents the moment arm of cam 160 as it pivots about its pivot point 210 (corresponding to the center of rivet 158). Line 212 represents the moment arm of lever 156 as it pivots about its pivot point 214 (corresponding to the center of rivet 154). For purposes of discussing the forces applied to interlock 72, it will be assumed that the cable 74 depicted in FIG. 6 is already in a low slack condition due to either an associated lock being activated, or another interlock having allowed another drawer to be opened. Interlock 72 depicted in FIG. 6 therefore must prevent its attached drawer from opening in order to function properly. If a person exerts a strong pulling force on the drawer attached to interlock 72 of FIG. 6, this force will be greatly reduced when it is eventually applied to cable 74. The pulling force exerted on the drawer in first direction 64 is transmitted to cam 160 by engagement member 86. Engagement member 86 engages cam 160 generally in recess 184. The pulling force exerted on the drawer, which is illustrated by the arrow $F_D$, acts on moment arm 208 at a point D. This point corresponds to the location where engagement member 86 contacts first surface 186 of recess 184. Force $F_D$ will cause cam 160 to rotate generally in a counter clock-wise direction, as depicted in FIG. 6. This rotation will cause edge 190 of cam 160 to push against crest 182 of lever 156 with a force of $F_C$. $F_C$ refers to the amount of force exerted by cam 160 on lever 156. Because force $F_C$ will be applied by cam 160 at a location that is farther away from pivot point 210 on moment arm 208, force $F_C$ will be less than force $F_D$.

The force $F_C$ will be applied to moment arm 212 of lever 156 at a position C. Position C is located on moment arm 212 at a position that is relatively close to pivot point 214. Force $F_C$ will be transferred via lever 156 to cable 74 at a point T. Point T refers to the position where engagement lug 104 engages cable 74. Because point T is substantially farther away from pivot point 214 along moment arm 212, the magnitude of force $F_T$ will be significantly less than the magnitude of force $F_C$. Further, the spring 81 will exert a force $F_S$ along lever 156 at a point S. This force $F_S$ acts in opposition to the force $F_T$. Because point S is farther away from pivot point 214 along moment arm 212, a smaller amount of force $F_S$ is necessary to cancel out the force $F_T$. The force $F_T$ that is exerted against cable 74 will therefore be greatly reduced as compared to the force $F_D$ that is exerted on the drawer. The tensioning force $F_T$ may be as little as $1/20^{th}$, or less, of the magnitude of the force $F_D$. Cable 74 can therefore resist drawer-pulling forces that greatly exceed its maximum tensile strength.

In addition to transferring only a fraction of the force of $F_D$ to cable 74, the arrangement of cam 160 and lever 156 also magnifies the movement of engagement lug 104 with respect to the rotation of cam 160. Stated alternatively, if the attached drawer is moved in first direction 64 a small distance A that causes cam 160 to partially rotate, the distance that engagement lug 104 moves in first direction 64 will be greater than the distance A. For example, if the drawer is moved in first direction 64 for 0.05 inches, this may cause engagement lug 104 to move 0.65 inches. This feature decreases the amount of movement in the locked drawers that might otherwise be present. A drawer that is locked will therefore only be able to be pulled a small distance before taut cable 74 prevents it from being opened. Interlock 72 can thus prevent drawers from being opened even for the small distance that might otherwise easily allow an intruder to insert a screw driver, or other lever mechanism, between the drawer and the cabinet.

Figure 22:
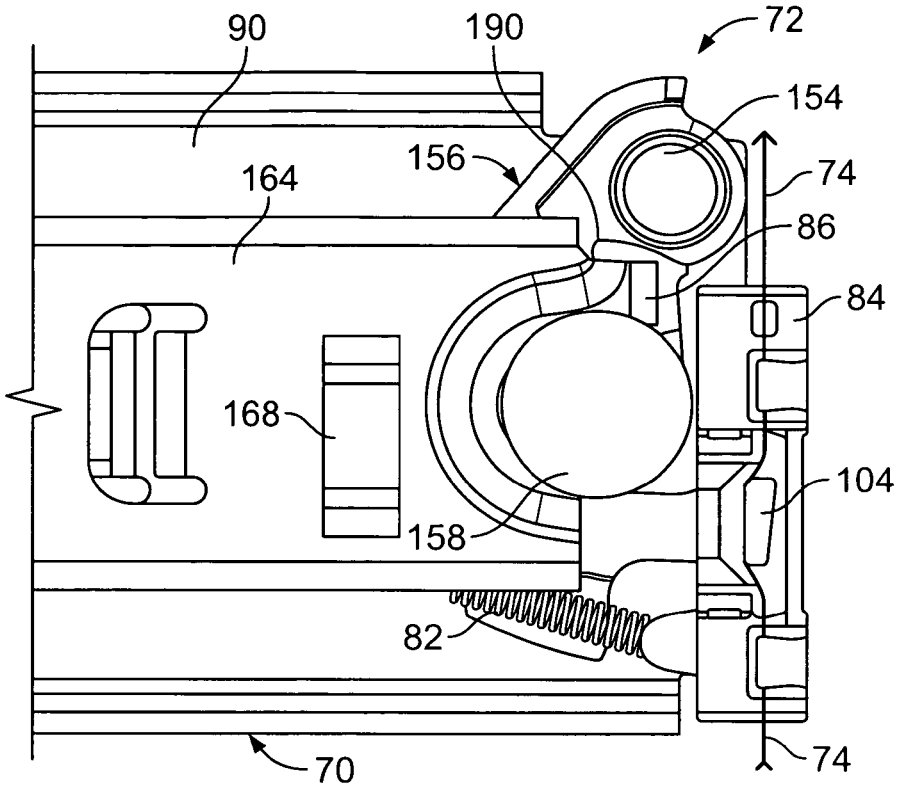
FIG. 22 is a side, elevational view of the interlock of FIG. 3 illustrated in a locked position.
Figure 23:
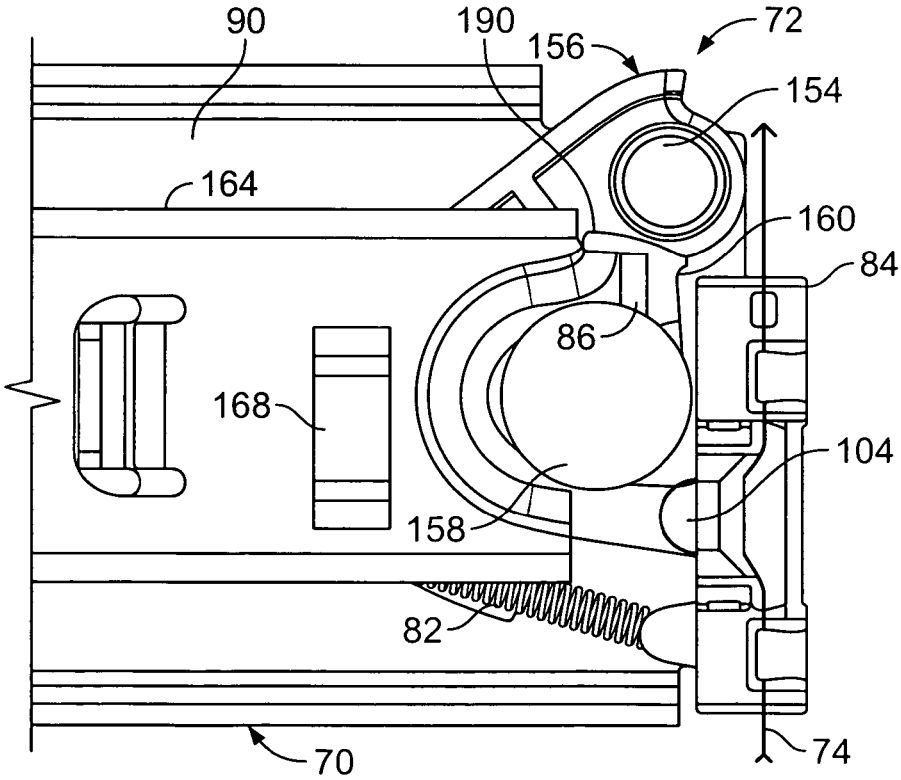
FIG. 23 is a side, elevational view of the interlock of FIG. 3 illustrated in a position in which two drawers are being simultaneously pulled toward the open position.

FIGS. 22-25 depict interlock 72 in several different states. In FIG. 22, interlock 72 is in the position it would be if someone were pulling on the attached drawer while the cable 74 (not shown) was in a low slack condition. The cable 74 would therefore prevent cam 160 in lever 156 of interlock 72 from rotating further than that depicted in FIG. 22. FIG. 23 depicts the position of interlock 72 when the drawer is trying to be pulled open simultaneously with another drawer. When two drawers are trying to be opened simultaneously, lever 156 can rotate more than it can in FIG. 22. However, the rotation of lever 156 is insufficient to allow edge 190 of cam 160 to travel past crest 182. Cam 160 therefore does not rotate sufficiently to allow engagement lever 86 to disengage from recess 184. Therefore, neither drawer being simultaneously pulled will allow it to be opened.

Figure 24:
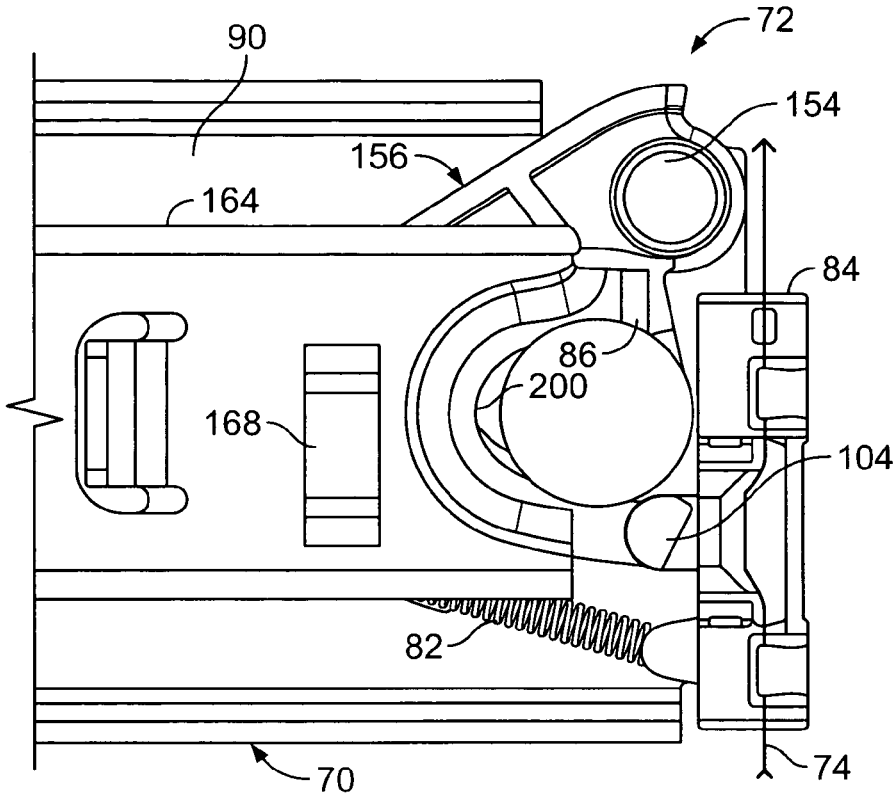
FIG. 24 is a side, elevational view of the interlock of FIG. 3 illustrating the interlock in an unlocked position with the engagement member in contact with the cam.
Figure 25:
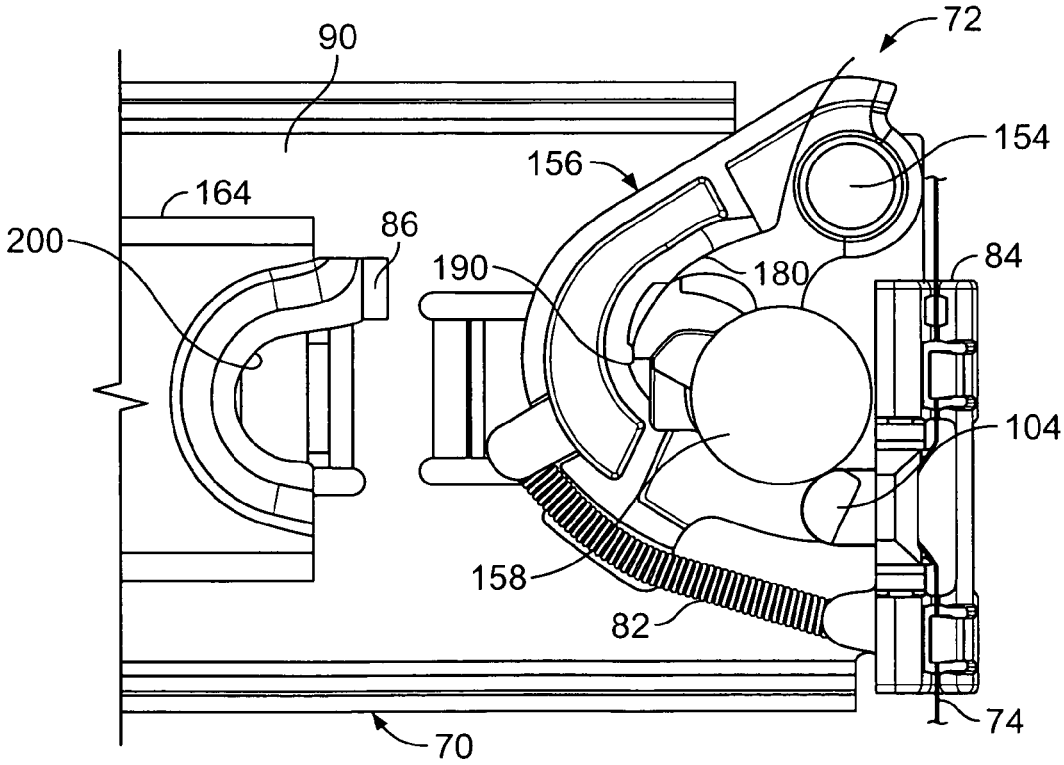
FIG. 25 is a side, elevational view of the interlock of FIG. 3 illustrated in an unlocked position in which the engagement member of the slide has moved out of engagement of the cam.

FIG. 24 depicts interlock 72 in its condition when engagement member 86 has just begun to disengage from recess 184. Engagement member 86 has moved to a greater extent than in FIGS. 22 and 23. This greater movement creates a sufficient force against cable 74 (not shown) to put the cable in a low slack condition, thereby preventing other drawers from being opened simultaneously. With surface 190 in contact with surface 180, lever 156 is prevented from rotating back, thereby maintaining cable 74 in the lower slack state when another drawer is attempted to be opened. FIG. 25 depicts an interlock 72 in which the drawer has opened sufficiently far to disengage engagement member 86 from recess 184.

An example of a lock 216 that may be used in conjunction with the present invention is depicted in FIGS. 26-30. Lock 216 selectively changes the condition of cable 74 from a high slack condition to a low slack condition. Lock 216 includes a hole 260, which may be a keyhole, into which a key may be inserted, or which may receive a bar that is coupled to a conventional lock cylinder. If hole 260 is a keyhole, insertion of the proper key therein allows a key cylinder 218 to be rotated by the key. If hole 260 receives a bar, which may be desirable where lock 216 is positioned at the back end of the cabinet, the bar is coupled to any conventional lock in a manner that causes the bar to be able to rotate about its longitudinal axis when the proper key is inserted into the conventional lock. In either situation, key cylinder 218 therefore will rotate when a proper key is used. Key cylinder 218 includes a pin 220 that moves in a cam track 222 defined in a reciprocating member 224. Reciprocating member 224 is snap-fittingly attached to a cover 226 by way of a flexible arm 228. Flexible arm 228 fits into an aperture 230 defined in cover 226. Flexible arm 228 includes a shoulder 232 that retains reciprocating member 224 to cover 226 when the two are snap fit together. The snap fitting occurs when flexible arm 228 initially contacts cover 226. A cam surface 234 causes flexible arm 228 to flex as reciprocating member 224 is initially pushed toward cover 226. After the two are completely secured together, flexible arm 228 snaps back to its unflexed condition in which shoulder 232 prevents the two members from being separated.

Figure 26:
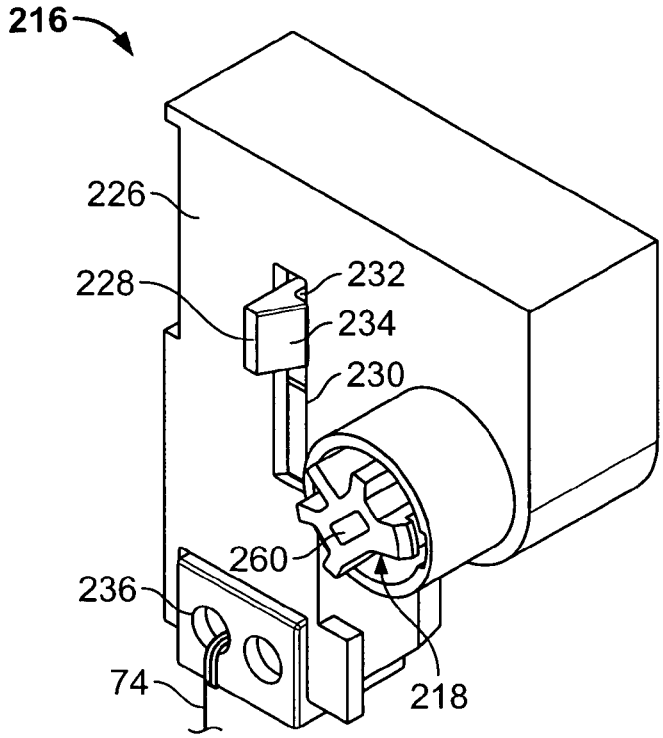
FIG. 26 is a perspective view of a lock illustrated in a locked position.
Figure 27:
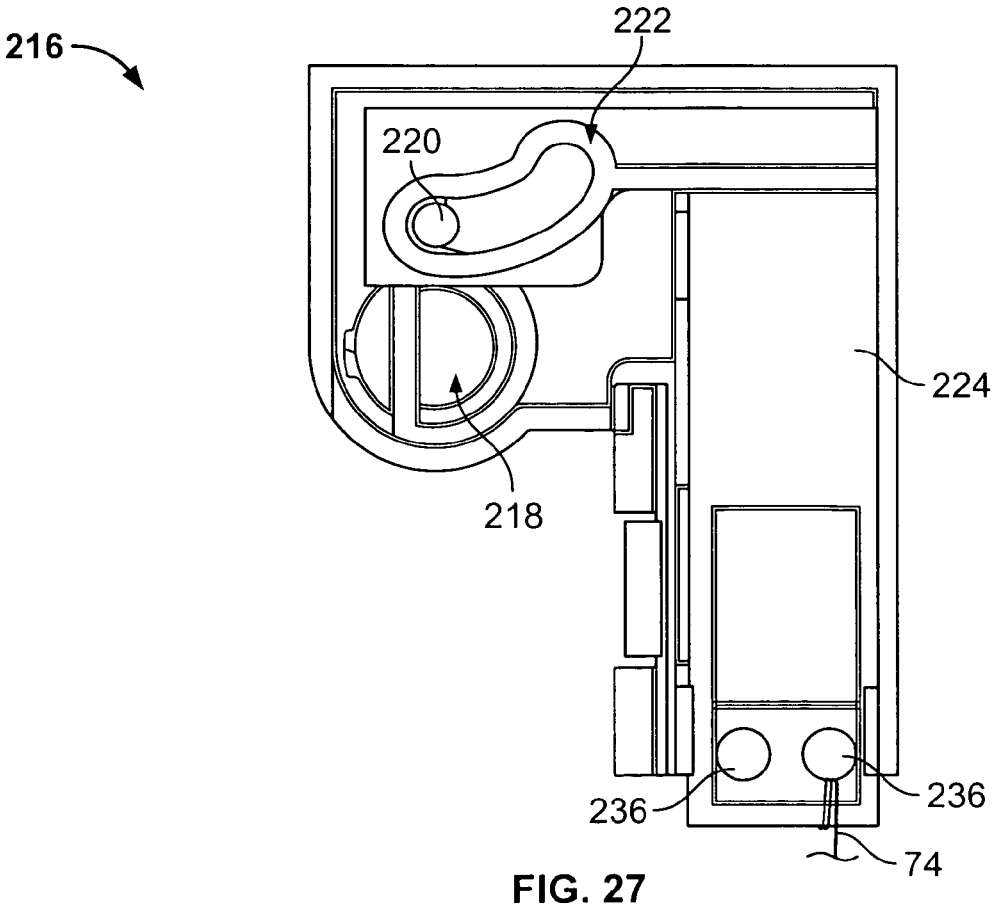
FIG. 27 is a rear, elevational view of the lock of FIG. 26 in the locked position.
Figure 28:
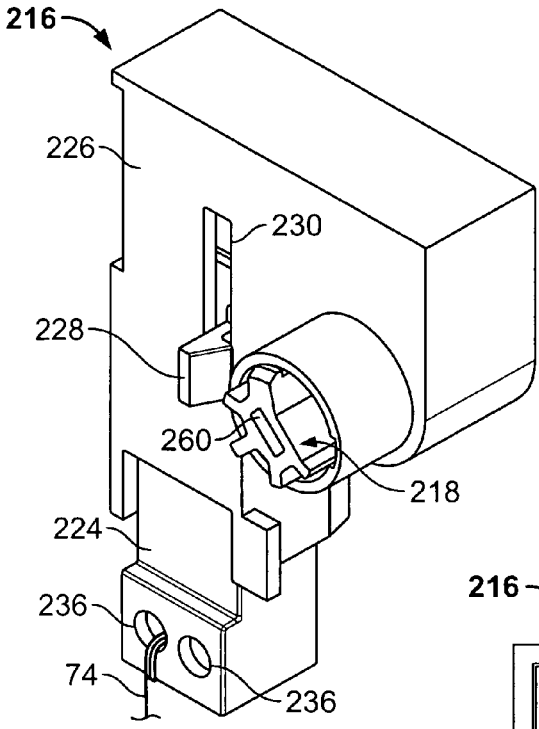
FIG. 28 is a perspective view of the lock of FIG. 26 illustrated in an unlocked position.
Figure 29:
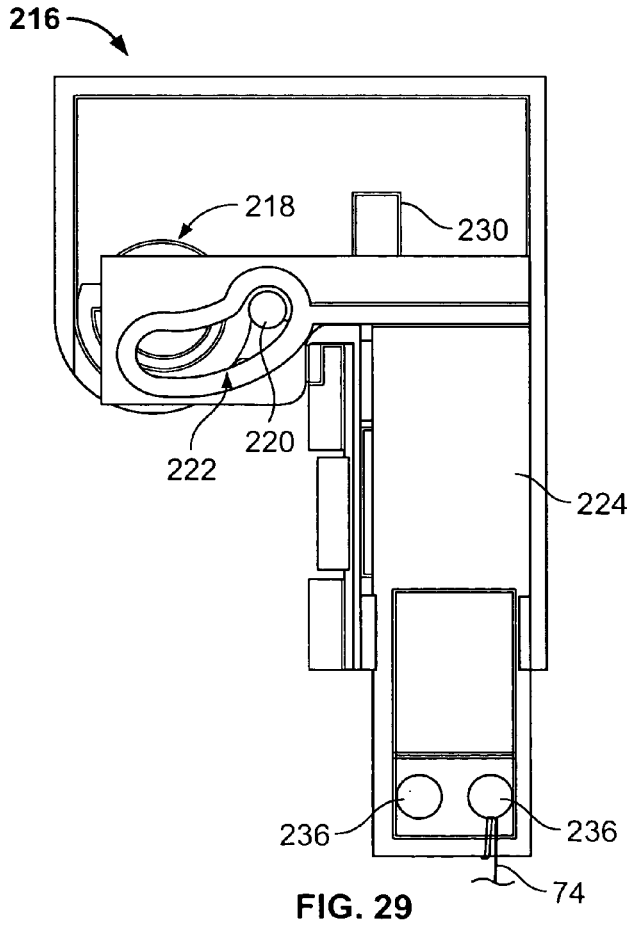
FIG. 29 is a rear, elevational view of the lock of FIG. 28 in the unlocked position.

Reciprocating member 224 includes a pair of apertures 236. Cable 74 may be secured to one of the apertures 236. When key cylinder 218 is rotated toward a locking condition, reciprocating member 224 moves vertically upward with respect to cover 226 (FIGS. 26-27). This vertical movement decreases the slack in cable 74 such that no drawers in the cabinet may be opened. When lock 216 is unlocked, the unlocking rotation of key cylinder 218 moves reciprocating member 224 vertically downward with respect to cover 226 (FIGS. 28-29). This creates sufficient slack in cable 74 for a single drawer to be opened. Cover 226 may be securely fastened inside of cabinet 60 in any suitable manner.

Figure 30:
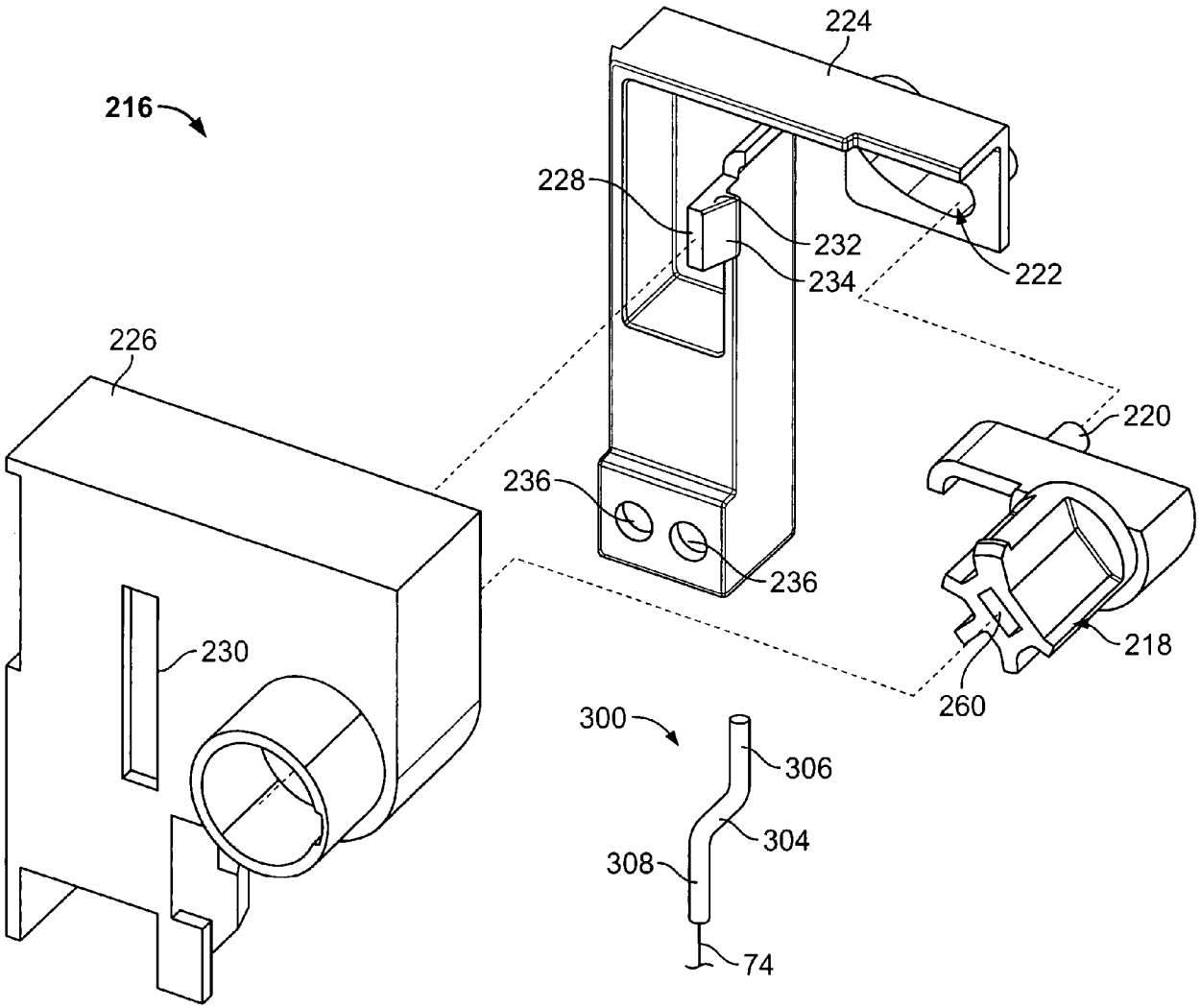
FIG. 30 is a perspective, exploded view of the lock of FIG. 26.

Cable 74 may be secured to one of apertures 236 by threading the cable therethrough and tying it, such as is illustrated in FIGS. 26-29. Alternatively, a more preferred method of securing cable 74 to apertures 236 is accomplished by way of a J-hook 300 (FIG. 30). J-hook 300 is crimped onto an end of cable 74 in a conventional manner. J-hook 300 includes a lower vertical section 302, a middle horizontal section 304, and an upper vertical section 306. Upper vertical section 306, along with a portion of horizontal section 304, is inserted through one of apertures 236 and manipulated until upper vertical section 306 contacts one side of the wall in which apertures 236 are defined and is oriented vertically. In this position, horizontal section 304 passes horizontally through the aperture 236 and lower vertical section 302 abuts against a side of the wall in which aperture 236 is defined that is opposite the side contacting upper section 306. In this position, J-hook 300 is maintained in aperture 236 and can only be released by manually twisting J-hook 300 appropriately to allow upper section 306 to be backed out of aperture 236. J-hook 300 thus provides a convenient way for installing and removing cable 74 from lock 216.

The opposite end of cable 74 may also be fastened within a cabinet by using a J-hook that fits through an aperture attached to the cabinet, although any other method of securing cable 74 can be used with the present invention. If it is desired to avoid having an end of cable 74 be attached to the frame of the cabinet, it could alternatively be held in place by interacting with cable guide 84. Specifically, an enlarged ring or other structure could be affixed to the end of the cable. This enlarged structure would be dimensioned so that it was too large to pass through the cable passageway defined in cable guide 84. For securing the bottom of the cable, the enlarged structure would thus abut against a bottom surface 310 of the lower-most cable guide 84 (FIGS. 15-17). If it were desired to secure the top end of the cable in a like manner to a cable guide 84, rather than to a lock 216, an enlarged structure could also be attached to the top end of cable 74. In this situation, the enlarged structure would abut against a top surface 312 of the uppermost cable guide 84. The enlarged structure may preferably be shaped to snap onto, or otherwise be secured to, cable guide 84. If an enlarged structure were used on both ends of the cable to secure it in the cabinet, the proper cable slack could be set by manufacturing the cable to the specific length that created the desired amount of slack.

Lock 216 could be modified so that reciprocating member 224 utilized a spring or other structure that selectively increased or decreased the tension on cable 74. In other words, rather than having reciprocating member 224 absolutely move to is raised position when the key is rotated to the locked position, lock 216 could be modified to include a spring, or other biasing force, that urged member 224 towards its upper, locked position. If no drawers were open, this biasing force would be sufficient to raise member 224 to its locked position. If one drawer were open, this biasing force would be insufficient to move the member 224 to its upper position because the cable would be in its low slack condition, thereby preventing member 224 from moving upward while the drawer was opened. As soon as a drawer was closed, however, the biasing force would move member 224 to is locked position and remove the slack in the cable that was created by the drawer closing. This arrangement allows the lock to be switched to the locked position while a drawer is still open. Once the drawer closed, it would immediately be locked and not able to be opened until the lock 216 was deactivated. The modified lock 216 thus would allow the cabinet to be locked while a drawer was still open, and as soon as the open drawer was closed, it would immediately lock. Thereafter, no drawers could be opened until the lock was deactivated. The biasing force exerted on reciprocating member 224 in modified lock 216 should be sufficient to remove the slack in cable 74 when all the drawers are closed and to maintain the cable in the locked, low slack condition when pulling forces are exerted against one or more locked drawers.

Lock 216 may be further modified to include a solenoid, or other electrically controlled switch, that controls the movement of reciprocating member 224 between its locked and unlocked position. The solenoid could be controlled remotely by a user using a hand-held device that transmitted wireless signals to a receiver in the cabinet that controlled the solenoid. The control could be carried out in a conventional manner, such as in the manner in which remote, keyless entry systems work on many current automobiles. Alternately, the cabinet could include a keypad, or other input device, in which the locking or unlocking of the cabinet was controlled by information, such as a code or password, input by a user.

While other materials may be used, interlock 72 may be made primarily of plastic. Specifically, lever 156, cam 160, and cable guide 84 may all be made of plastic. Drawer slide 70 is preferably made of metal, such as steel, with the exception of the ball bearing cages 166 for the ball bearings, which may be made of plastic. First and second rivets 154 and 158, stationary portion 90, and slidable portion 164 may also all be made of metal, such as steel. Spring 82 may exert a force of approximately 0.5 pounds. Other spring strength may, of course, be used. Cable 74 may be a steel cable composed of seven strands, with each strand made of seven individual filaments. Cable 74 may have a tensile strength of 40 pounds. Cable 74 may preferably be made of stainless steel and include a vinyl coating. The diameter of cable 74 after coating may be 0.024 inches, although other dimensions can be used. To avoid kinking of cable 74, surfaces that come in contact with cable 74, such as engagement lug 104, may be curved with a radius of at least 0.125 inches to help reduce the possibility of kinking. As several possible alternatives to steel, cable 74 could be a string, a plastic based line, such as those used as fishing lines, or any other elongated, flexible member with suitable tensile strength.

A single interlock 72 is all that is needed for each drawer in the cabinet. The opposite drawer slide can thus be a regular drawer slide with no interlock attached. Interlock 72, of course, can be attached directly to the cabinet, rather than integrated with the drawer slide. During the installation of the interlock system into a cabinet, the slack in the cable may be easily set by securing one end of the cable, opening a single drawer, and then pulling the cable until substantially all of its slack is removed. The cable is then secured in that condition. When the drawer is thereafter closed, the cable will have sufficient slack to allow only a single drawer to be opened at a time. Alternatively, cables 74 could be manufactured at a preset length to fit different cabinet heights. The installer of the interlocks therefore could simply fasten the cable in the desired location and the length of the cable will create the appropriate slack to allow a single drawer to be opened. Once the appropriate length of a cable is determined for a given cabinet height, cables could be easily mass-produced by a manufacturer by simply cutting them to the appropriate lengths.

Figure 31:
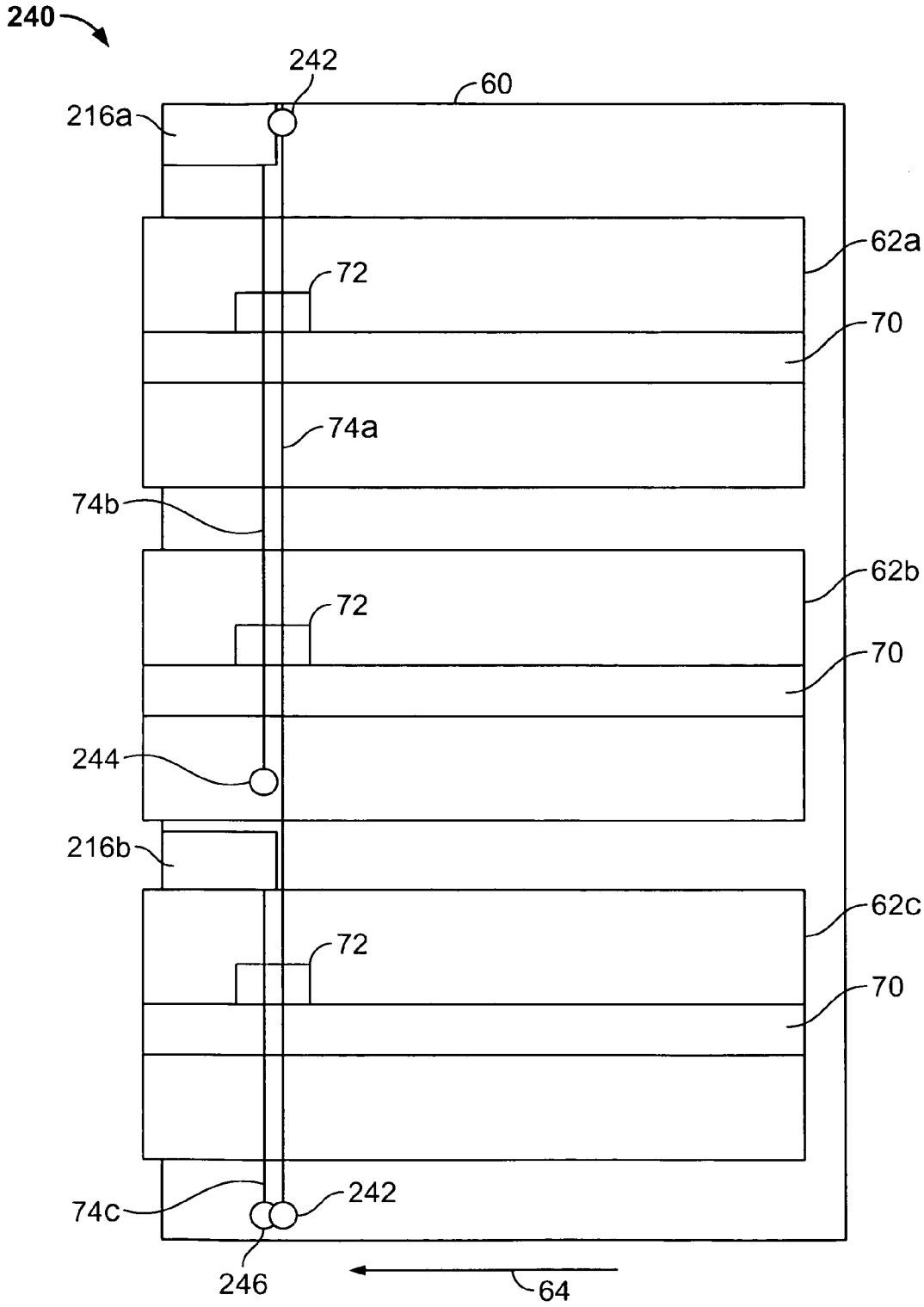
FIG. 31 is a side, sectional view of a cabinet and interlock system according to one aspect of the present invention.

An interlock system 240 is depicted in FIG. 31. Interlock system 240 is depicted on cabinet 60, which includes three drawers 62*a-c*. Interlock system 240 includes three interlocks 72. An upper lock 216*a* and a lower lock 216*b* are included. Upper lock 216*a* is adapted to selectively lock the uppermost two drawers 62*a* and *b*. Lower lock 216*b* is adapted to selectively lock the lower drawer 62*c*. An interlock cable 74*a* extends vertically within cabinet 60 and runs through each of the interlocks 72 for each of the drawers 62*a-c*. Cable 74*a* is attached within the cabinet at attachment points 242, which may utilize J-hooks 300, or any other suitable means, for attaching cable 74*a* within cabinet 60. These alternative means may include a screw, a bolt, or other means. An upper cable 74*b* runs vertically from upper lock 216*a* through the two interlocks 72 of the uppermost two drawers 62*a* and *b*. The lower end of upper cable 74*b* is secured at an attachment point 244, which may be positioned above lowermost drawer 262*c*. Alternatively, attachment point 244 may be positioned below drawer 62*c*, but cable 74*b* should not run through interlock 72 of lowermost drawer 62*c*. Lower cable 74*c* extends vertically from lower lock 216*b* to the bottom of cabinet 60. Lower cable 74*c* is secured to the bottom of cabinet 60 at an attachment point 74*c*. The interlock 72 of upper drawer 62*a* and *b* thus have two cables 74*a* and *b* passing through them. Cable 74*a* and *b* may be threaded through interlock 72 in the same manner as has been described previously. Specifically, both cables 74*a* and *b* may be threaded through cable guides 84 and around engagement lug 104.

When either cable 74*a* or *b* is in the low slack condition, interlock 72 will prevent the associated drawers 62*a* or *b* from being opened. If both cables 74*a* and *b* are in the low slack condition, interlock 72 will also, of course, prevent the associated drawers 62*a* or *b* from being opened. Because cable 72*a* also runs through the interlock associated with the lowermost drawer 62*c*, only one drawer in the entire cabinet may be opened at a given time. Cable 74*c*, which runs through the interlock 72 of the lowermost drawer 62*c*, allows the lowermost drawer 62*c* to be selectively locked independently of the locking of the uppermost two drawers 62*a* and *b*. Cables 74*a* and *c*, which run through interlock 72 of the lowermost drawer 62*c*, may be run side by side through interlock 72 in the same manner that has been described above. Alternatively, an additional engagement lug 104 may be provided on all of the interlocks that extends outwardly in an opposite direction to engagement lug 104. Cable guide 84 may be modified to include a second channel to accommodate the second cable and align it with the added engagement lug. Other modifications may be made to accommodate the second cable. System 240 allows the two upper drawers to be locked independently of the lower-most drawer while only a single drawer may be opened at any time if either or both of the locks are not activated.

While the present invention has been described in terms of the preferred embodiments depicted in the drawings and discussed in the above specification, it will be understood by one skilled in the art that the present invention is not limited to these particular preferred embodiments, but includes any and all such modifications that are within the spirit and scope of the present invention as defined in the following claims.

What is claimed is:

1. An interlock for a drawer potitionable within a cabinet, the drawer being movable in the cabinet in a first direction toward an open position and in a second, opposite direction toward a closed position, said interlock comprising:

an elongated, flexible member;

a rotatable lever adapted to switch the amount of slack in said elongated, flexible member between a low slack condition and a high slack condition by rotating between a first and second position, respectively;

an engagement positioned to cause said rotatable lever to rotate toward said first position when said drawer is initially moved from the closed position in the first direction; and a biasing member positioned adjacent said lever, said biasing member adapted to exert a biasing force that tends to prevent said lever from rotating from said second position to said first position until said drawer is moved in said first direction to the open position.

2. The interlock of claim 1 wherein said biasing member is a spring.

3. The interlock of claim 2 wherein said spring is coupled to said lever.

4. The interlock of claim 1 wherein said elongated, flexible member is a cable.

5. The interlock of claim 1 wherein said elongated, flexible member is in communication with at least one other drawer interlock associated with another drawer, said at least one other drawer interlock adapted to change said elongated, flexible member from the high slack to the low slack condition when the at least one other drawer is moved to an open position.

6. The interlock of claim 5 further including a cable guide adapted to snap-fittingly receive the cable from at least one direction.

7. The interlock of claim 1 wherein said elongated, flexible member is in communication with a lock, said lock adapted to selectively change said elongated, flexible member between said low and high slack conditions.

8. The interlock of claim 7 further including a second, elongated flexible member in communication with a second lock and said lever, said second lock adapted to selectively change said second elongated, flexible member between said low and high slack conditions.

9. The interlock of claim 1 wherein said lever and said biasing member are to be mounted on a drawer slide member.

10. The interlock of claim 9 wherein said interlock is to be solely mounted to said drawer slide member.

11. The interlock of claim 1 wherein said rotatable lever is configured to translate a first force exerted on the drawer in the first direction into a second force exerted against said elongated, flexible member that is less than said first force.

12. The interlock of claim 11 wherein said second force is less than one-half of said first force.

13. The interlock of claim 11 wherein said second force is less than one-fifth of said first force.

14. The interlock of claim 13 wherein said interlock is to be secured to an end of a drawer slide.

15. The interlock of claim 11 wherein said second force is less than one-twentieth of said first force.

16. An interlock for a drawer positionable within a cabinet, the drawer being movable in the cabinet in a first direction toward an open position and in a second, opposite direction toward a closed position, said interlock comprising:

an elongated, flexible member adapted to be changeable between a high slack condition and a low slack condition;

an actuating member positioned to be operatively engageable with said elongated, flexible member, said actuating member adapted to change said elongated, flexible member to said low slack position when the drawer is opened and to allow said elongated flexible member to exist in said high slack condition when the drawer is closed, said actuating member adapted to translate a first force exerted on said drawer in said first direction to a second force on said elongated, flexible member which is less than said first force; and said actuating member comprising a rotatable lever adapted to alter the amount of slack in said elongated, flexible member, said lever being rotatable between a low slack position and a high slack position, said low slack position creating the low slack condition in said elongated, flexible member and said high slack position allowing said elongated, flexible member to exist in the high slack condition.

17. The interlock of claim 16 wherein an engagement member is adapted to be attached to said drawer and positioned to cause said rotatable lever to rotate to said low slack position when said drawer is initially moved in the first direction from the closed position.

18. The interlock of claim 17 wherein said lever is prevented from rotating to said low slack position by said elongated, flexible member when said elongated, flexible member is in said low slack condition.

19. The interlock of claim 18 wherein when said lever is in said low slack position said drawer is prevented from being moved to said open position.

20. The interlock of claim 19 wherein said elongated, flexible member is a cable.

21. The interlock of claim 20 wherein said second force is less than one-half of said first force.

22. The interlock of claim 21 wherein said cable is in communication with a lock, said lock adapted to selectively change said cable to said low slack condition.

23. The interlock of claim 22 wherein said lever and said retainer are to be mounted to a drawer slide.

24. The interlock of claim 20 wherein said second force is less than one-tenth of said first force.

25. The interlock of claim 16 further including a retainer adapted to retain said rotatable lever in said low slack position while said drawer is moved to said open position.

26. The interlock of claim 25 wherein said retainer includes a cam member coupled to said lever.

27. The interlock of claim 16 further including a spring that exerts a force on said lever that resists movement of said lever from said high slack position to said low slack position.

28. The interlock of claim 16 wherein said cable is in communication with a lock, said lock adapted to selectively change said cable to said low slack condition such that said drawer is prevented from being moved to the open position when said cable is in said low slack condition.

29. A locking and interlocking system composing:

a lock;

a first elongated, flexible member to extend between at least first and second drawers, said first elongated, flexible member being changeable from a high slack condition to a low slack condition;

a second elongated, flexible member to extend between said lock and said first drawer, said lock adapted to change said second elongated, flexible member from a high slack condition to a low slack condition;

a first interlock in communication with said first and second elongated, flexible members, said first interlock adapted to change both said first and second elongated, flexible members from the high slack condition to the low slack condition, said first interlock adapted to prevent said first drawer from opening whenever said first or second elongated, flexible members are in said low slack condition; and a second interlock in communication with said first elongated, flexible member, said second interlock adapted to change said first elongated, flexible member from the low slack to the high slack condition, said second interlock adapted to prevent said second drawer from opening whenever said first elongated, flexible member is in said low slack condition.

30. The system of claim 29 further including a second lock and a third elongated, flexible member, said second lock adapted to change said third cable from a high slack condition to a low slack condition, said third elongated, flexible member extending between said second lock and said second drawer, said second interlock further being adapted to change said third elongated, flexible member from the high slack condition to the low slack condition whenever said second drawer is opened, said second interlock further adapted to prevent said second drawer from being opened whenever said third elongated, flexible member is in said low slack condition.

31. The system of claim 30 wherein said first interlock exerts a force against said first and second elongated, flexible members that is less than one-fifth of a force exerted against said first drawer in said first direction.

32. The system of claim 31 wherein said first interlock includes a biasing member that exerts a biasing force against said first and second elongated, flexible members whenever said first drawer is moved to said open position, said biasing force being substantially constant.

33. The system of claim 32 wherein said biasing member includes a spring.

34. The system of claim 29 wherein said first interlock is to be mounted to a first drawer slide that slidingly supports said first drawer and said second interlock is to be mounted to a second drawer slide that slidingly supports said second drawer.

35. The system of claim 34 wherein said first and second drawer slides are to be removable from a cabinet.

36. The system of claim 29 wherein said first and second elongated, flexible members are cables.

37. An interlock for a drawer positionable within a cabinet, the drawer being movable in the cabinet in a first direction toward an open position and in a second, opposite direction toward a closed position, said interlock comprising:

an elongated, flexible member adapted to be changeable between a high slack condition and a low slack condition;

a cam member having a driving surface; and an actuating member positioned to be operatively engageable with said elongated, flexible member, and engageable with the cam driving surface, said actuating member adapted to change said elongated, flexible member to said low slack position when the diner is opened and to allow said elongated flexible member to exist in said high slack condition when the drawer is closed, and wherein the actuating member is adapted to mow with respect to the elongated, flexible member faster than the driving surface moves when the drawer is initially being moved toward an open position.

38. The interlock of claim 37 wherein the actuating member further comprises a rotatable lever.

39. The interlock of claim 37 wherein the cam member is rotatable.

40. The interlock of claim 37 further comprising a spring that exerts a force on said actuating member.

41. The interlock of claim 37 wherein the actuating member is adapted to move a distance with respect to the elongated, flexible member at least five times greater than the distance the drawer moves when initially being moved toward an open position.

* * * * *

UNITED STATES PATENT AND TRADEMARK OFFICE

CERTIFICATE OF CORRECTION

PATENT NO. : 7,293,845 B2
APPLICATION NO. : 11/455454
DATED : November 13, 2007
INVENTOR(S) : Keith A. Hoffmann It is certified that error appears in the above-identified patent and that said Letters Patent is hereby corrected as shown below:

Title Page, line 1 of the Abstract Section before "for file cabinets" delete "Interlocks" and insert --The invention relates to interlocks--.

Col. 15, line 33 after "an engagement" insert --member--;

Col. 17, line 15 after "interlocking system" delete "composing" and insert --comprising--;

Col. 18, line 33 after "when the" delete "diner" and insert --drawer--; and

Col. 18, line 36 after "adapted to" delete "mow" and insert --move--.

Signed and Sealed this

Eleventh Day of March, 2008

JON W. DUDAS
*Director of the United States Patent and Trademark Office*